US009766571B2

(12) United States Patent
Baba et al.

(10) Patent No.: US 9,766,571 B2
(45) Date of Patent: Sep. 19, 2017

(54) PROCESS CARTRIDGE WITH DEVELOPING CONTAINER FOR AN IMAGE FORMING APPARATUS

(71) Applicant: CANON KABUSHIKI KAISHA, Tokyo (JP)

(72) Inventors: Daisuke Baba, Mishima (JP); Makoto Tokudome, Yokohama (JP); Masao Uyama, Mishima (JP); Yuichiro Hirata, Susono (JP); Kodai Hayashi, Suntou-gun (JP); Keisuke Mochizuki, Suntou-gun (JP); Norihito Naito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/927,317

(22) Filed: Oct. 29, 2015

(65) Prior Publication Data

US 2016/0062265 A1 Mar. 3, 2016

Related U.S. Application Data

(63) Continuation of application No. 14/366,660, filed on Jun. 18, 2014, now Pat. No. 9,213,257.

(30) Foreign Application Priority Data

Dec. 21, 2011 (JP) ..... 2011-280093
Jun. 25, 2012 (JP) ..... 2012-142030
Nov. 30, 2012 (JP) ..... 2012-263254

(51) Int. Cl.
*G03G 15/08* (2006.01)

(52) U.S. Cl.
CPC ..... *G03G 15/081* (2013.01); *G03G 15/0812* (2013.01)

(58) Field of Classification Search
CPC ..... G03G 15/0812
(Continued)

(56) References Cited

U.S. PATENT DOCUMENTS 4,563,978 A * 1/1986 Nakamura
5,485,249 A * 1/1996 Higeta
(Continued)

FOREIGN PATENT DOCUMENTS

JP H07219401 A 8/1995
JP 07325531 A * 12/1995
(Continued)

*Primary Examiner* — Benjamin Schmitt
*Assistant Examiner* — Milton Gonzalez
(74) *Attorney, Agent, or Firm* — Canon U.S.A., Inc. IP Division

(57) ABSTRACT

A developing device configured to develop a latent image formed on an image bearing member includes a rotatable developing-agent bearing member configured to bear developing agent, a developing container configured to form a developing-agent storage chamber that stores the developing agent, a developing-agent regulating portion provided in the developing container to regulate an amount of the developing agent born on the developing-agent bearing member, a support portion configured to support the developing-agent bearing member movably relative to the developing-agent regulating portion, and a pressurizing member configured to pressurize the developing-agent bearing member toward the developing-agent regulating portion. A contact portion of the developing-agent regulating portion with the developing-agent bearing member is fixed to the developing container without forming a gap from the developing container on a downstream side in a pressurizing direction of the pressurizing member.

4 Claims, 19 Drawing Sheets

(58) Field of Classification Search
USPC ..... 399/274, 284
See application file for complete search history.

(56) References Cited

U.S. PATENT DOCUMENTS

| | | | | |
|---|---|---|---|---|
| 6,356,730 | B1 * | 3/2002 | Nonaka | G03G 15/0812 |
| 7,655,169 | B2 * | 2/2010 | Goto | |
| 2008/0298848 | A1 * | 12/2008 | Lee | G03G 15/0812<br>399/274 |

FOREIGN PATENT DOCUMENTS

| | | | | |
|---|---|---|---|---|
| JP | H09062096 | A | | 3/1997 |
| JP | 2002328525 | A | * | 11/2002 |

* cited by examiner

PROCESS CARTRIDGE WITH DEVELOPING CONTAINER FOR AN IMAGE FORMING APPARATUS

CROSS-REFERENCE TO RELATED APPLICATIONS

This application is a continuation of U.S. patent application Ser. No. 14/366,660 filed Jun. 18, 2014, which claims the benefit of Japanese Patent Application No. 2011-280093 filed Dec. 21, 2011, No. 2012-142030 filed Jun. 25, 2012 and No. 2012-263254 filed Nov. 30, 2012, all of which are hereby incorporated by reference herein in their entirety.

TECHNICAL FIELD

The present invention relates to a developing device, a process cartridge, and an image forming apparatus.

Here, an image forming apparatus forms an image on a recording medium. Examples of image forming apparatuses are an electrophotographic copying machine, an electrophotographic printer (e.g., an LED printer or a laser beam printer), and an electrophotographic facsimile machine.

A process cartridge is formed by integrating at least an image bearing member and a developing device into a cartridge, and is removably mounted in an apparatus body of the image forming apparatus. A developing device develops an electrostatic latent image formed on an image bearing member.

BACKGROUND ART

For example, in an electrophotographic image forming apparatus (hereinafter referred to as an "image forming apparatus") such as a copying machine or a laser beam printer, an electrostatic image (electrostatic latent image) is formed by applying light corresponding to image data onto an electrophotographic photosensitive member (photosensitive member). Toner serving as developing agent is supplied from a developing device to the electrostatic image to develop the electrostatic image into a visible toner image. This toner image is transferred from the photosensitive member onto a recording medium, such as recording paper, by a transfer device, and is then fixed on the recording medium by a fixing device. Through the above procedure, a recorded image is obtained.

Various developing devices using a dry one-component developing method have been proposed. In an example of such a developing device, toner serving as one-component developing agent is stored in a developing container. The toner is born on a developing roller rotatably fixed in the developing container, and a toner layer of a uniform thickness is formed by a developing-agent regulating member. The developing roller bearing the toner layer is located close to or in contact with the photosensitive member and, for example, a developing bias voltage including an alternating-current component and a direct-current component is applied to the developing roller to generate a potential difference between the electrostatic image on the photosensitive member and a developing sleeve. The toner is thereby transferred onto the electrostatic image to develop the electrostatic image.

As a method for regulating the thickness of the toner layer formed on the developing roller, a so-called cantilevered method is disclosed in Japanese Patent Laid-Open No. 5-142933. In this method, an elastic regulation blade is used as a developing-agent regulating member, and is fixed to a developing container such as to contact with a developing-agent bearing member in a bent state. Since a pressure generated by bending the regulation blade is used as a regulation pressure for regulating the developing agent, a desired regulation pressure can be stably obtained even if mount positions of the developing-agent bearing member and the developing-agent regulating member vary.

Japanese Patent Laid-Open No. 9-211966 discloses a method in which a rigid body is used as a developing-agent regulating member and a spring member is provided between the developing-agent regulating member and a developing container. The developing-agent regulating member is pressed against a developing-agent bearing member from above by the spring member. Since a biasing pressure of the spring member is used as a regulation pressure for the developing agent, a desired regulation pressure can be stably obtained even if mount positions of the developing-agent bearing member and the developing-agent regulating member vary.

In recent years, the image forming apparatus has been required to have not only higher image quality but also smaller size, in particular, smaller thickness.

However, in the structure disclosed in Japanese Patent Laid-Open No. 5-142933, the regulation pressure for the developing agent is obtained by bending the elastic regulation blade. For this reason, as illustrated in FIG. 27, a space S1 where a regulation blade 23 is bent is needed to be formed between a fixing portion for fixing the regulation blade 23 to a developing container 22 and a regulation position 25 for the developing agent set on the developing-agent bearing member 24.

In the structure disclosed in Japanese Patent Laid-Open No. 9-211966, as illustrated in FIG. 28, a space S2 storing a developing-agent regulating member 28 formed by a rigid body and a spring member 29 is needed to be formed above a developing-agent bearing member 24 and between a developing container 26 and a regulation position 27 for the developing agent.

CITATION LIST

Patent Literature

[PTL 1]
Japanese Patent Laid-Open No. 5-142933
[PTL 2]
Japanese Patent Laid-Open No. 9-211966

SUMMARY OF INVENTION

In view of the above problems, the present invention provides a developing device and a process cartridge that are reduced in size and thickness, while maintaining a regulation pressure and a regulation position for developing agent.

A developing device according to an aspect of the present invention develops a latent image formed on an image bearing member. The developing device includes: a rotatable developing-agent bearing member configured to bear developing agent; a developing container configured to form a developing-agent storage chamber that stores the developing agent; a developing-agent regulating portion provided in the developing container to regulate an amount of the developing agent born on the developing-agent bearing member; a support portion configured to support the developing-agent bearing member movably relative to the developing-agent regulating portion; and a pressurizing member configured to press the developing-agent bearing member toward the developing-agent regulating portion. A contact portion of the developing-agent regulating portion with the developing-agent bearing member is fixed to the developing container without forming a gap from the developing container on a downstream side in a pressurizing direction of the pressurizing member.

A process cartridge according to another aspect of the present invention is removably mounted in an apparatus body of an image forming apparatus. The process cartridge includes: an image bearing member on which a latent image is to be formed; a rotatable developing-agent bearing member configured to bear developing agent for developing the latent image; a developing container configured to form a developing-agent storage chamber that stores the developing agent; a developing-agent regulating portion provided in the developing container to regulate an amount of the developing agent born on the developing-agent bearing member; a support portion configured to support the developing-agent bearing member movably relative to the developing-agent regulating portion; and a pressurizing member configured to press the developing-agent bearing member toward the developing-agent regulating portion. A contact portion of the developing-agent regulating portion with the developing-agent bearing member is fixed to the developing container without forming a gap from the developing container on a downstream side in a pressurizing direction of the pressurizing member.

Further features of the present invention will become apparent from the following description of exemplary embodiments with reference to the attached drawings.

DESCRIPTION OF EMBODIMENTS

[First Embodiment]

Figure 1:
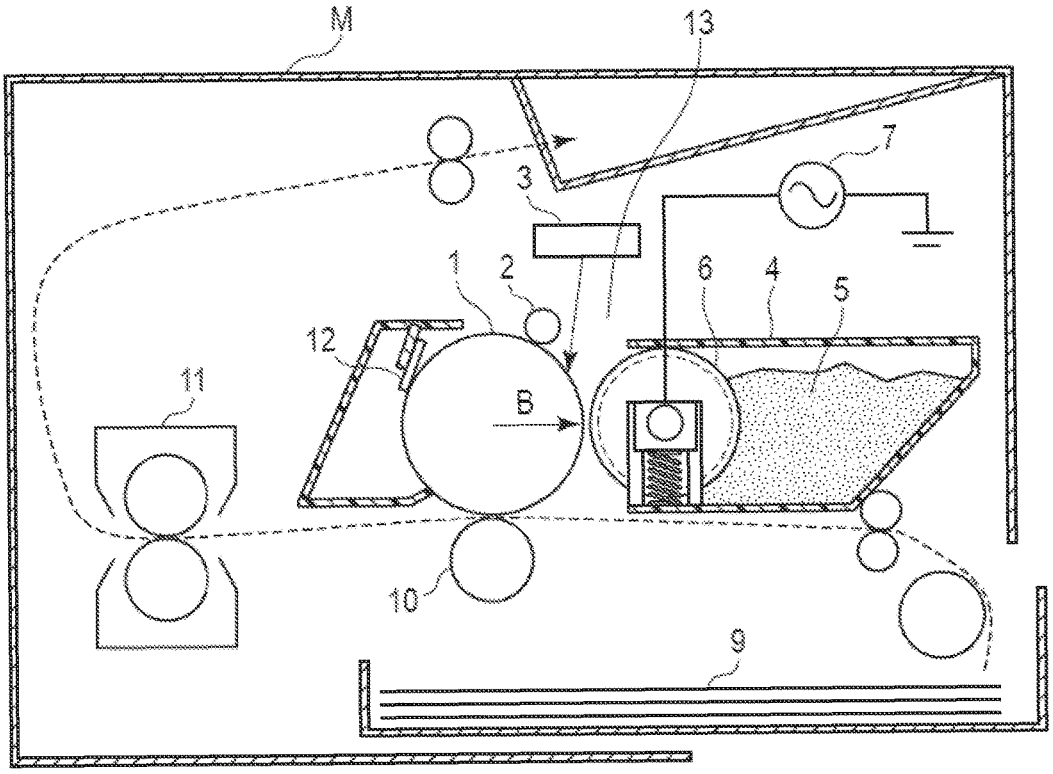
FIG. 1 is a cross-sectional view of an image forming apparatus.

FIG. 1 schematically illustrates a configuration of an image forming apparatus according to a first embodiment. The image forming apparatus of the first embodiment is a monochrome laser beam printer that forms an image on a recording medium, such as paper, by an electrophotographic process.

In almost the center of an apparatus body M of the image forming apparatus, a drum type photosensitive member 1 is provided as an image bearing member (hereinafter referred to as a photosensitive drum 1). The photosensitive drum 1 is obtained by forming an organic photoconductor (OPC) sensitive layer on an outer peripheral surface of an electrically conductive drum base body of aluminum or the like. The photosensitive drum 1 is rotated in a direction of arrow R1 at a predetermined process speed (peripheral speed) of 200 mm/s.

A surface (peripheral surface) of the above-described photosensitive drum 1 is uniformly charged in predetermined polarity and potential by a charging roller 2 serving as a charging unit. The charged surface of the photosensitive drum 1 is exposed by a laser beam output from a laser beam scanner 3 serving as an exposure unit. The laser beam is modulated according to desired image information to form an electrostatic latent image on the photosensitive drum 1. Toner 5 serving as a developing agent is stuck to the electrostatic latent image by a developing device 4 serving as a developing unit to develop the electrostatic latent image as a toner image.

A recording medium 9 is fed by a feeding roller, and is conveyed to a transfer nip between the photosensitive drum 1 and a transfer roller 10 in synchronization with the toner image written on the photosensitive drum 1, where the toner image is transferred onto the recording medium 9. To the transfer roller 10, a transfer bias is applied from a transfer-bias application power supply (not illustrated) during transfer.

The recording medium 9, on which the toner image is transferred, is separated from the surface of the photosensitive drum 1, and is conveyed to a fixing device 11 serving as a fixing unit, where the recording medium 9 is heated and pressurized to fix the toner image on a surface of the recording medium 9. In contrast, after the toner image is transferred, the photosensitive drum 1 is cleaned of the toner 5, which remains on the surface of the photosensitive drum 1 without being transferred on the recording medium 9, by a cleaning member 12 serving as a cleaning unit, and is then used for the next image forming operation.

In the image forming apparatus of the first embodiment, four process units, namely, the photosensitive drum 1, the charging roller 2, the developing device 4, and the cleaning member 12 are integrated to form a process cartridge (process unit) 13, which is removably mounted in the apparatus body M.

[General Structure of Developing Device]

Figure 2:
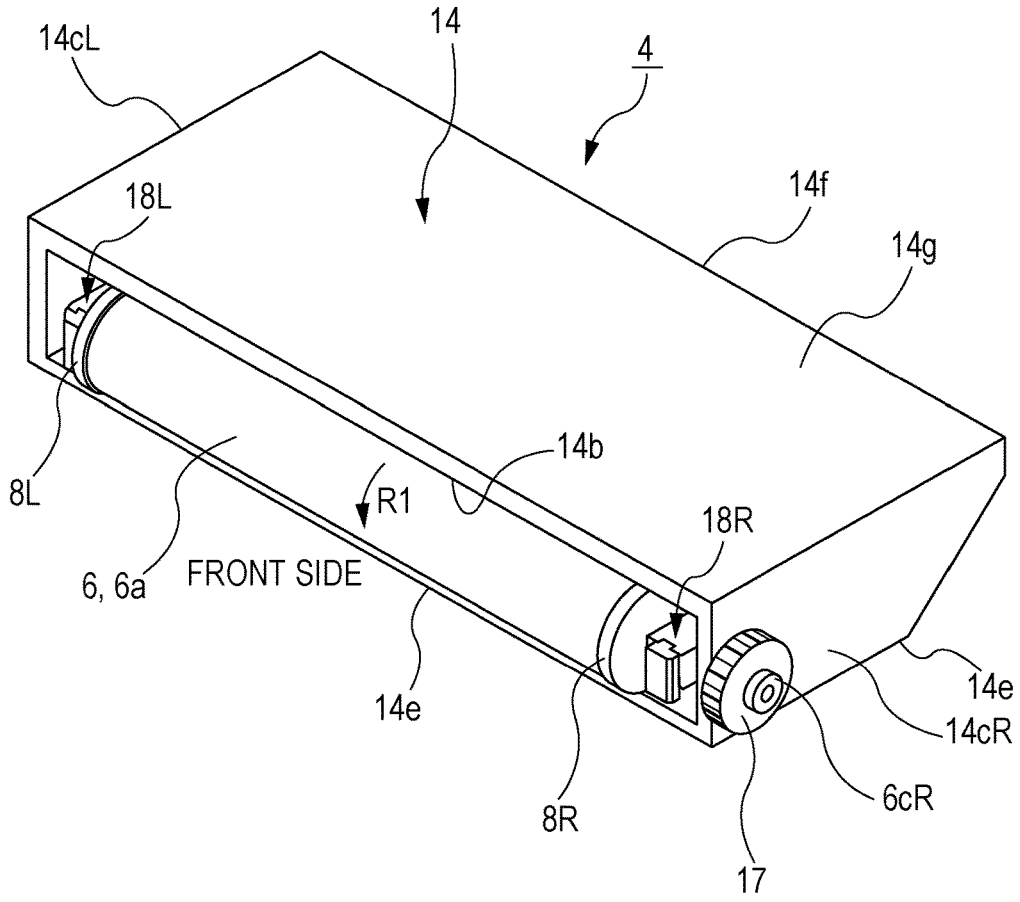
FIG. 2 is a perspective view of a developing device.
Figure 3:
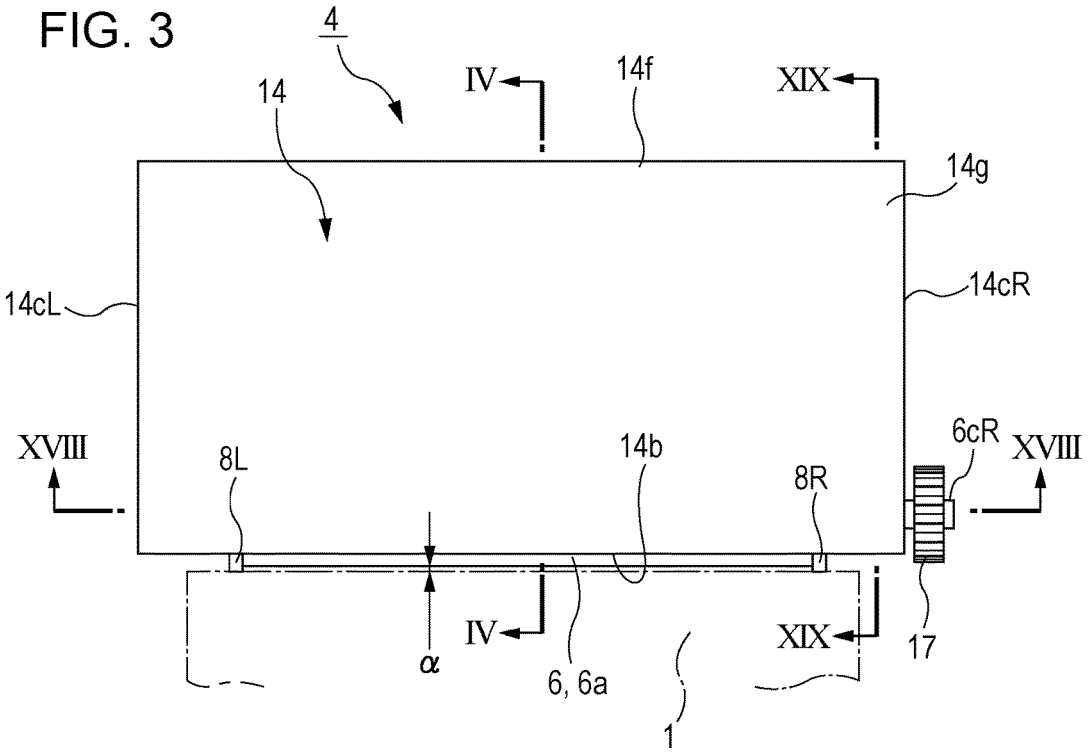
FIG. 3 is a plan view of the developing device.
Figure 4:
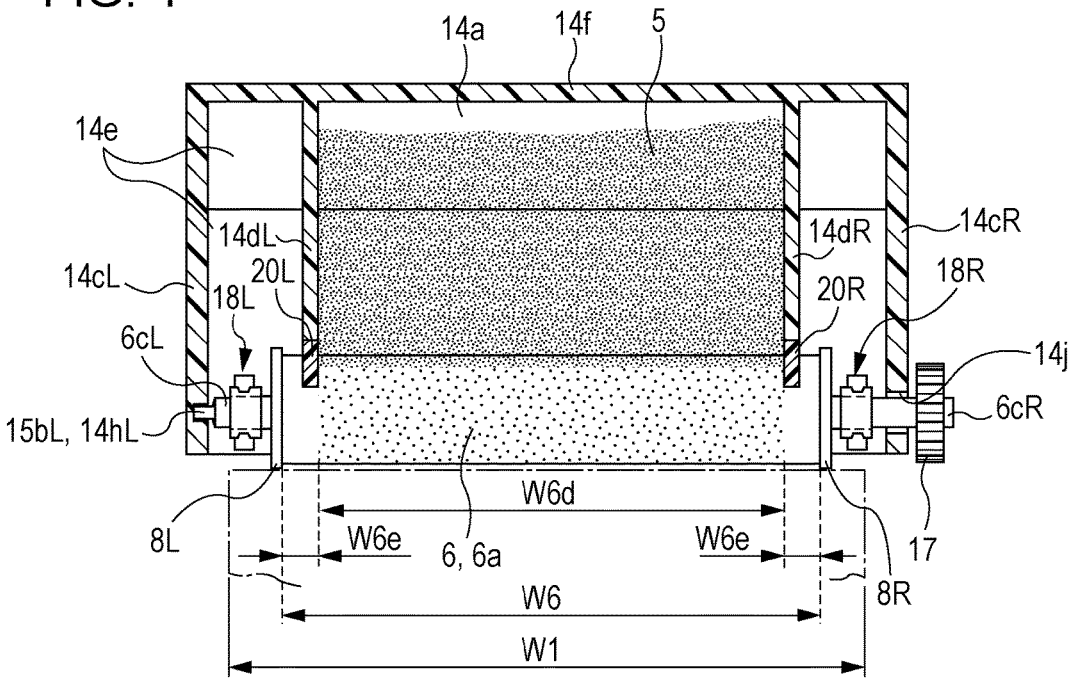
FIG. 4 is an internal plan view of the developing device.
Figure 5:
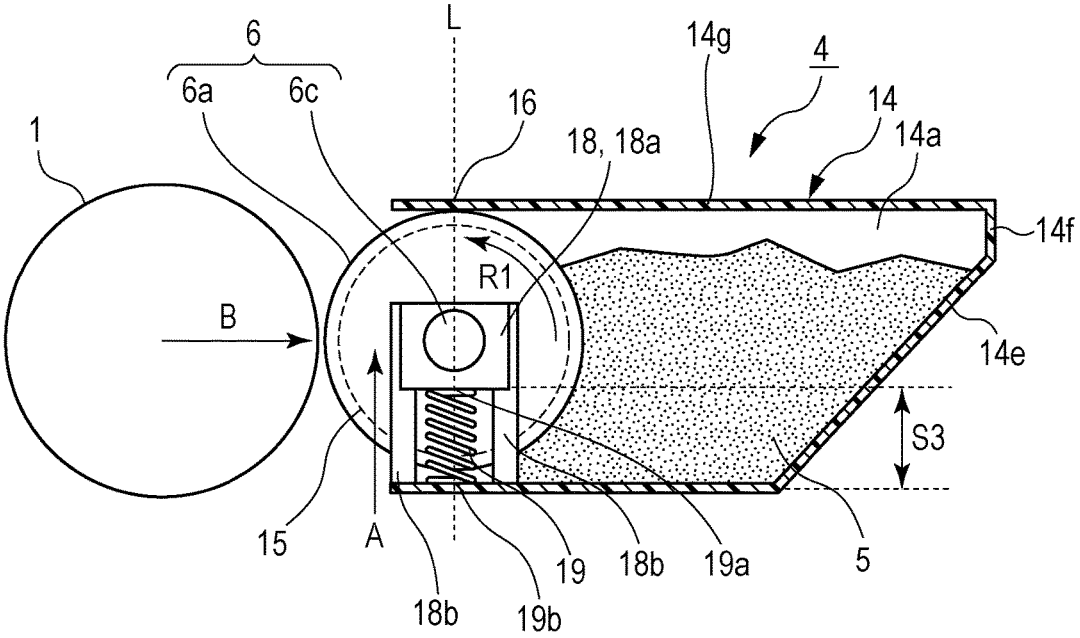
FIG. 5 is a cross-sectional view of the developing device.

The developing device that characterizes the first embodiment will be described with reference to FIGS. 1 to 5. FIG. 2 is an external perspective view of the developing device 4 in the first embodiment. FIG. 3 is a plan view of the developing device 4. FIG. 4 is an internal plan view of the developing device 4 from which a ceiling plate 14*g* of a developing container 14 illustrated in FIG. 3 is removed. FIG. 5 illustrates the process cartridge 13 of the first embodiment.

In the following description, a front side of the developing device 4 refers to a side where a developing sleeve opposes a photosensitive drum serving as an image bearing member. A near side and a fore side are synonymous with the front side. A back side of the developing device 4 refers to a side opposite the front side. A depth side and a rear side are synonymous with the back side. Right and left sides refer to right and left sides when viewed from the front side. Upper and lower sides refer to upper and lower sides in a gravitational direction. A longitudinal direction refers to an axial direction of a rotating body or a direction parallel to the axial direction. When the reference numeral has a suffix L or R, it denotes a member provided on a left side (L) or a right side (R) of the developing device, unless otherwise specified.

In the first embodiment, a developing sleeve 6 serving as a developing-agent bearing member is provided in the developing device 4. A gap of about 300 micrometers is provided between the developing sleeve 6 and the photosensitive drum 1. During development, a developing bias voltage serving as a superimposed voltage of a direct-current component and an alternating-current component is applied from a developing-bias power supply 7 to the developing sleeve 6. Specifically, in the first embodiment, a superimposed voltage, in which an alternating-current component has a frequency of 2.5 kH and an amplitude of 1.6 kV and a direct-current component is −400 V, is applied. By the action of the developing bias, the toner 5 is transferred from the developing sleeve 6 onto an electrostatic latent image formed on the photosensitive drum 1.

As illustrated in FIGS. 2, 3, and 4, ring-shaped spacers 8L and 8R are concentrically attached to opposite ends of the developing sleeve 6. The spacers 8L and 8R have a thickness of 300 micrometers, and keep the gap between the photosensitive drum 1 and the developing sleeve 6 at 300 micrometers by contact with the photosensitive drum 1. When a direction in which the photosensitive drum 1 is pressed against the developing sleeve 6 is referred to as a drum pressing direction B (see FIG. 5), the drum pressing direction B of the first embodiment is a direction connecting the centers of the photosensitive drum 1 and the developing sleeve 6.

The developing sleeve 6 is rotated by driving force from the unillustrated image forming apparatus body M that is received by a drive gear 17 provided at one end (drive side end) of the developing sleeve 6. In the following description, a side of the developing sleeve 6 in the longitudinal direction where the drive gear 17 is provided is sometimes referred to as a drive side, and a side opposite the drive side is sometimes referred to as a non-drive side.

In the developing device 4 of the first embodiment, the toner 5 serving as the developing agent is stored in a developing-agent storage chamber 14*a* formed by a developing container 14. The developing container 14 is molded from high-impact polystyrene resin (HI-PS). The toner 5 is magnetic toner, and a normal charging polarity thereof (normal polarity), that is, a polarity to which the toner 5 is charged for image formation is a negative polarity. The developing sleeve 6 serving as the developing-agent bearing member is rotatably provided in an opening portion 14*b* (see FIG. 2) of the developing device 4 opposing the photosensitive drum 1.

As illustrated in FIG. 4, in the developing container 14, a left inner side plate 14*d*L extends in a front-rear direction near a left side plate 14*c*L of the developing container 14 with a predetermined space therebetween. Also, a right inner side plate 14*d*R extends in the front-rear direction near a right side plate 14*c*R of the developing container 14 with a predetermined space therebetween. In the opening portion 14*b* (see FIG. 2) at the front side of the developing container 14, the developing sleeve 6 is rotatably held by left and right bearing mechanisms 18 (18L, 18R) such that an axial direction of the developing sleeve 6 extends in a right-left direction.

In the developing container 14 of the first embodiment, an enclosed space surrounded by a bottom plate 14*e*, the left inner side plate 14*d*L, the right inner side plate 14*d*R, a rear plate 14*f*, the ceiling plate 14*g* of the developing container 14 and the developing sleeve 6 serves as the developing-agent storage chamber 14*a*.

In the developing container 14 of the first embodiment, as illustrated in FIG. 5, an almost rear half of the bottom plate 14*e* is an inclined face that slopes downward and frontward from the rear plate 14*f* toward the developing sleeve 6 so that the toner 5 in the developing-agent storage chamber 14*a* is flowable toward the developing sleeve 6. In the developing-agent storage chamber 14*a*, a paddle member (toner agitating and conveying member) can be provided to rotate to agitate the toner 5 and to positively move the toner 5 toward the developing sleeve 6.

In FIG. 4, W6 represents an overall width of the developing sleeve 6 (a sleeve portion 6*a*) (overall length of the developing sleeve 6). A distance between the left and right spacers 8L and 8R nearly corresponds to the overall width W6 of the developing sleeve 6. W1 represents an overall width of the photosensitive drum 1 (overall length of the photosensitive drum 1), which is larger than the distance W6 between the spacers 8L and 8R.

W6*d* represents a developing-agent supply region width in the developing sleeve 6, and W6*e* represents a developing-agent non-supply region width. The developing-agent supply region width W6*d* nearly corresponds to the maximum image forming region width on the photosensitive drum 1. In the first embodiment, the developing-agent supply region width W6*d* is defined by the distance between the left inner side plate 14*d*L and the right inner side plate 14*d*R of the developing container 14. An overall width of a developing-agent regulating portion 16 (overall length of the developing-agent regulating portion 16) W16 nearly corresponds to the developing-agent supply region width W6*d*. The developing-agent non-supply region width W6*e* is a width of portions of the developing sleeve 6 outside the distance between the left inner side plate 14*d*L and the right inner side plate 14*d*R.

Elastic seal members 20 (20L and 20R) for preventing leakage of the toner 5 from gaps are provided between a front side of the left inner side plate 14*d*L and the developing sleeve 6 and between a front side of the right inner side plate 14*d*R and the developing sleeve 6.

The developing sleeve 6 of the first embodiment is obtained by forming an electrically conductive resin layer containing binding resin, conductive micropowder, and roughening particles on a cylindrical aluminum element tube having a diameter of 16 mm. The developing sleeve 6 has a volume resistivity of $10^{-2}$ to $10^{4}$ ohm-cm. Phenol resin is used as the binding resin, carbon black and graphite are used as the conductive micropowder, and spherical carbonized particles are used as the roughening particles.

As illustrated in FIG. 5, a magnet roller 15 serving as a magnetic-field generating member for generating a magnetic field is fixed in the developing sleeve 6. The toner 5 is attracted and taken onto the developing sleeve 6 by magnetic force of the magnet roller 15.

As described above, the developing sleeve 6 is rotatably provided, and is rotated in a direction of arrow R1 so that the toner 5 attracted on the developing sleeve 6 is regulated by the developing-agent regulating portion 16. The developing-agent regulating portion 16 is a part of the developing container 14. That is, the developing-agent regulating portion 16 is provided integrally with the developing container 14.

In the first embodiment, the amount of toner 5 on the developing sleeve 6 is regulated to a desired amount by rotating the developing sleeve 6 in pressing contact with the developing-agent regulating portion 16 of the developing container 14. A surface of the developing-agent regulating portion 16 is substantially smooth, and has a surface roughness R of 0.15 micrometer. The developing sleeve 6 has a surface roughness Ra of 1.2 micrometer. The surface roughness R refers to an arithmetic average roughness (center line average roughness) specified by JIS-B0601-1994 (micrometer), and was measured with a contact-type surface roughness measuring instrument SE3500 (manufactured by Kosaka Laboratory Ltd.) under the following conditions:

Reference length: 0.8 mm
Evaluation length: 4.0 mm
Measuring speed: 0.1 mm
Filter: Gaussian filter In the first embodiment, a contact pressure with which the developing sleeve 6 contacts with the developing-agent regulating portion 16 is 30 g/cm in a linear pressure. The contact pressure is obtained through the following procedure. Three SUS sheets (having a thickness of 50 micrometers and a width of w cm) are inserted in a contact nip between the developing sleeve 6 and the developing-agent regulating portion 16 in a state in which there is no toner, and a spring pressure F (gf) when the middle sheet is pulled out is measured. A friction coefficient u between the SUS sheets is measured. Then, a contact pressure (linear pressure) P (=uF/w) is found.

In the above-described structure, the charge amount (charge amount per unit weight) of toner, which is born on the developing sleeve 6 after passing by the developing-agent regulating portion 16, is 10 microC (microcoulomb)/g. The amount of toner (weight per unit area), which is born on the developing sleeve 6 after passing by the developing-agent regulating portion 16, is 15 g/m$^2$.

Moving and pressurizing mechanisms for the developing sleeve 6 will be described with reference to FIGS. 5, 6, and 7. As illustrated in FIG. 5, the developing sleeve 6 is pressurized at ends in a longitudinal direction and pressed against the developing-agent regulating portion 16 as a part of the developing container 14 by elastic members (hereinafter referred to as spring members) 19 serving as pressurizing members. The longitudinal direction of the developing sleeve 6 is a direction (axial direction) parallel to a rotation axis of the developing sleeve 6.

Figure 6:
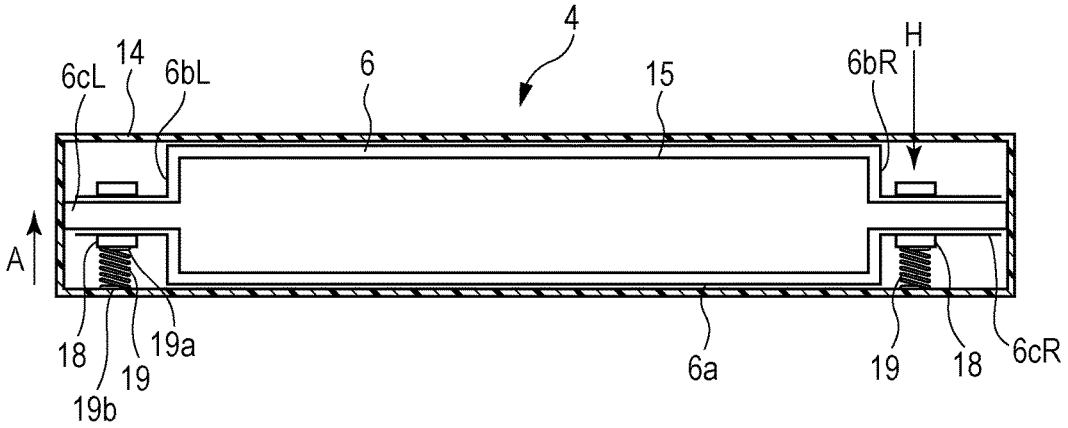
FIG. 6 is a cross-sectional view of the developing device.

FIG. 6 is a cross-sectional view, taken along dotted line L of FIG. 5. As illustrated in FIG. 6, the developing sleeve 6 is pressurized at both ends in the longitudinal direction by the spring members 19.

The developing sleeve 6 is rotatably attached to bearing mechanisms 18. Each of the bearing mechanisms 18 includes guide members 18*b*, and a bearing member 18*a* to be guided by the guide members 18*b*. The bearing members 18*a* support shafts of the developing sleeve 6. Each of the spring members 19 is attached at one ends 19*a* to the corresponding bearing members 18*a*. The other end 19*b* of the spring member 19 is abutted against the developing container 14. The spring members 19 pressurize the developing sleeve 6 toward the developing-agent regulating portion 16 with the bearing members 18*a* being disposed therebetween.

As illustrated in FIG. 6, the developing sleeve 6 includes a columnar sleeve portion (bearing portion) 6*a* that bears the toner and shaft portions 6*c* (6*c*L and 6*c*R) having a diameter smaller than that of the sleeve portion 6*a*. The developing sleeve 6 further includes left and right endplate portions 6*b*L and 6*b*R that close left and right apertures of the sleeve portion 6*a*. The shaft portions 6*c* are concentric with the sleeve portion 6*a*, and have an outer diameter smaller than an outer diameter of the sleeve portion 6*a*. The bearing members 18*a* rotatably support the developing sleeve 6 at the shaft portions 6*c*.

For this reason, as illustrated in FIG. 5, when the developing device 4 is viewed in the longitudinal direction of the developing sleeve 6, the ends 19*a* of the spring members 19 attached to the bearing members 18*a* are located on an inner side of an outer periphery of the sleeve portion 6*a*. A region S3 in the developing container 14 occupied by the spring members 19 nearly overlaps with a region occupied by the developing sleeve 6. Hence, the developing container 14 does not need to have a new space where the spring members 19 are mounted.

That is, since the spring members 19 pressurize the developing sleeve 6 at the shaft portions 6*c* having a small diameter, the space necessary to mount the spring members 19 is reduced, and this can further reduce the size of the developing device 4. As illustrated in FIG. 5, the bearing members 18*a* are slidable along the guide members 18*b* provided in the developing container 14.

Figure 7:
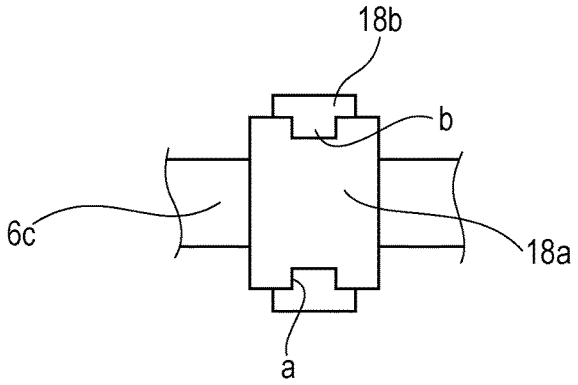
FIG. 7 illustrates a structure for pressurizing a developing sleeve.

FIG. 7 illustrates one end (drive side end) of the developing sleeve 6, as viewed in a direction H of FIG. 6. The bearing member 18*a* has guide grooves a that form recesses, and the recesses are fitted on projections b of the guide members 18*b* provided on the developing container 14. This structure allows the bearing member 18*a* to move along the guide members 18*b* in a direction of arrow A of FIG. 5. That is, the bearing member 18*a* can move the developing sleeve 6 in the direction of arrow A into contact with the developing-agent regulating portion 16.

The developing sleeve 6 is slidable only in the direction of arrow A of FIG. 5. This moving direction of the developing sleeve 6 also corresponds to a pressurizing direction A of the spring members 19. The pressurizing direction A is a direction that connects the center of the developing sleeve 6 and the developing-agent regulating portion 16, and forms an angle T (see FIG. 8) of 90 degrees with the above-described drum pressing direction B. The other end (non-drive side end) of the developing sleeve 6 is also supported by a similar structure.

In the first embodiment, the developing sleeve 6 is pressed against the developing-agent regulating portion 16, which does not move relative to the developing container 14, by the pressure from the spring members 19 provided at opposite ends of the developing sleeve 6. This structure stably maintains the regulation pressure for regulating the toner born on the developing sleeve 6 and the regulation position of the toner. That is, the amount of toner 5 born on the developing sleeve 6 and the thickness of a toner layer formed on the developing sleeve 6 can be kept constant while further reducing the size and thickness of the developing device 4.

Figure 27:
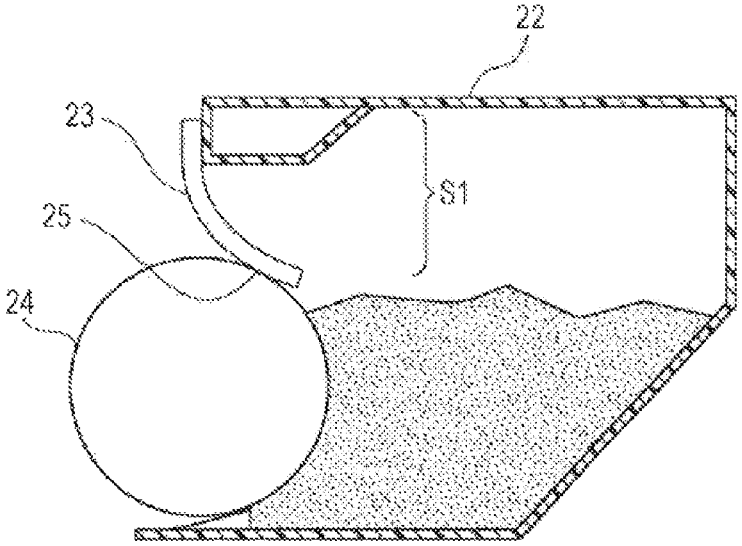
FIG. 27 Prior Art
FIG. 27 illustrates the related art.
Figure 28:
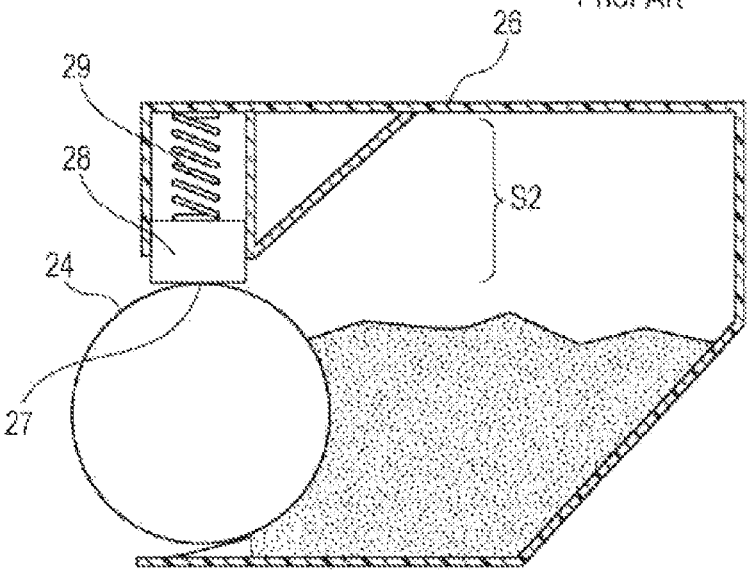
FIG. 28 Prior Art
FIG. 28 illustrates the related art.

That is, in the related art, the space S1 where the regulation blade 23 is bent and the space S2 where the spring 29 for pressing the developing-agent regulating member 28 against the developing-agent bearing member 24 is mounted are necessary, as illustrated in FIGS. 27 and 28. As a result, size reduction of the developing containers 22 and 26 is difficult.

Figure 8:
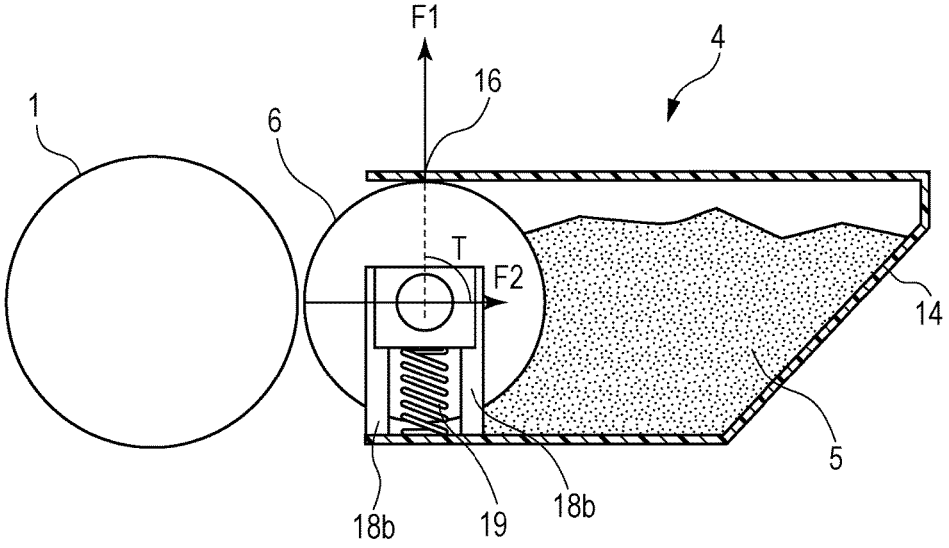
FIG. 8 is a cross-sectional view of the developing device.

In contrast, in the first embodiment, as illustrated in FIG. 8, the developing-agent regulating portion 16 is provided integrally with the developing container 14, and there is no gap between the developing-agent regulating portion 16 and the developing container 14. Thus, the size of the developing container 14 can be reduced easily.

In the related art, the regulation position 25 of the regulation blade 23 (see FIG. 27) in contact with the developing-agent bearing member 24 is provided apart from the developing container 22. That is, the contact portion of the regulation blade 23 in contact with the developing-agent bearing member 24 and the developing container 22 are spaced from each other to form a space where the regulation blade 23 deforms. For this reason, the regulation position 25 may be slightly moved by deformation of the regulation blade 23.

In contrast, the developing-agent regulating portion 16 and the developing container 14 are integrally formed in the first embodiment illustrated in FIG. 8. For this reason, even when the developing-agent regulating portion 16 receives the pressure from the spring members 19 via the developing sleeve 6, the contact portion of the developing-agent regulating portion 16 with the developing sleeve 6 (position to regulate the developing agent) does not move relative to the developing container 14.

That is, the developing-agent regulating portion 16 and the developing container 14 are not spaced from each other in the first embodiment. On a downstream side of the contact portion between the developing-agent regulating portion 16 and the developing sleeve 6 in the pressurizing direction A, there is no space that allows deformation of the developing-agent regulating portion 16 relative to the developing container 14. Hence, even when the developing-agent regulating portion 16 is pressed by the spring members 19, the position of the contact portion of the developing-agent regulating portion 16 with the developing sleeve 6 is fixed relative to the developing container 14.

Thus, the developing-agent regulating portion 16 can stably regulate the amount of developing agent on the developing sleeve 6.

The regulation force for the developing agent can be increased, for example, by roughening the developing-agent regulating portion 16. When a so-called fogging phenomenon in which a large amount of toner is born on the developing sleeve 6 and the toner is transferred to margins of a recording medium, occurs, the amount of toner born on the developing sleeve 6 can be reduced by roughening the developing-agent regulating portion 16.

To roughen the developing-agent regulating portion 16, a surface of a mold used to mold the developing-agent regulating portion 16 can be blasted at random to form irregularities.

For example, when the surface roughness Ra of the developing-agent regulating portion 16 was increased to 1.2 micrometer by roughening, the amount of toner, which was born on the developing sleeve 6 after passing by the developing-agent regulating portion 16, was 12 g/m$^2$. This refers to the weight of toner born on the developing sleeve 6 per unit area, and is smaller than when the surface of the developing-agent regulating portion 16 is made substantially flat without being roughened.

In the first embodiment, the sleeve pressurizing direction A in which the developing sleeve 6 is pressed against the developing-agent regulating portion 16 by the spring members 19 is the direction that connects the center of the developing sleeve 6 and the developing-agent regulating portion 16. However, the direction is not limited thereto as long as the developing sleeve 6 is pressed against the developing-agent regulating portion 16 in that direction. While the drum pressing direction B in which the photosensitive drum 1 presses the developing sleeve 6 forms an angle T of 90 degrees with the sleeve pressurizing direction A in which the developing sleeve 6 is pressed against the developing-agent regulating portion 16 by the spring members 19 in the first embodiment, as illustrated in FIG. 5, the angle is not limited thereto as long as the developing sleeve 6 and the developing-agent regulating portion 16 are not separated by the force of the photosensitive drum 1 for pressing the developing sleeve 6.

In this case, Expression (1) described below holds:

$$F1+F2\cos T>0 \quad (1)$$

As illustrated in FIG. 8, F1 represents a force with which the spring members 19 press the developing sleeve 6 against the developing-agent regulating portion 16. F2 represents a force with which the photosensitive drum 1 presses the developing sleeve 6. T represents an angle formed between an acting direction of F1 and an acting direction of F2 in a plane orthogonal to the axis of the developing sleeve 6 (FIG. 8).

F2 cos T in the left side of Expression (1) represents a component of F2 acting in the pressurizing direction A of the spring members 19. This component takes a positive value when the angle T is smaller than 90 degrees and takes a negative value when the angle T is larger than 90 degrees.

When Expression (1) holds, the force of the spring members 19 for pressing the developing sleeve 6 against the developing-agent regulating portion 16 becomes larger than the force of the photosensitive drum 1 for separating the developing sleeve 6 from the developing-agent regulating portion 16.

While the developing-agent bearing member is formed by the aluminum sleeve in the first embodiment, it is not limited thereto. For example, the developing-agent bearing member may be formed by a rubber roller, and the developing agent may be nonmagnetic toner.

[Second Embodiment]

Figure 9:
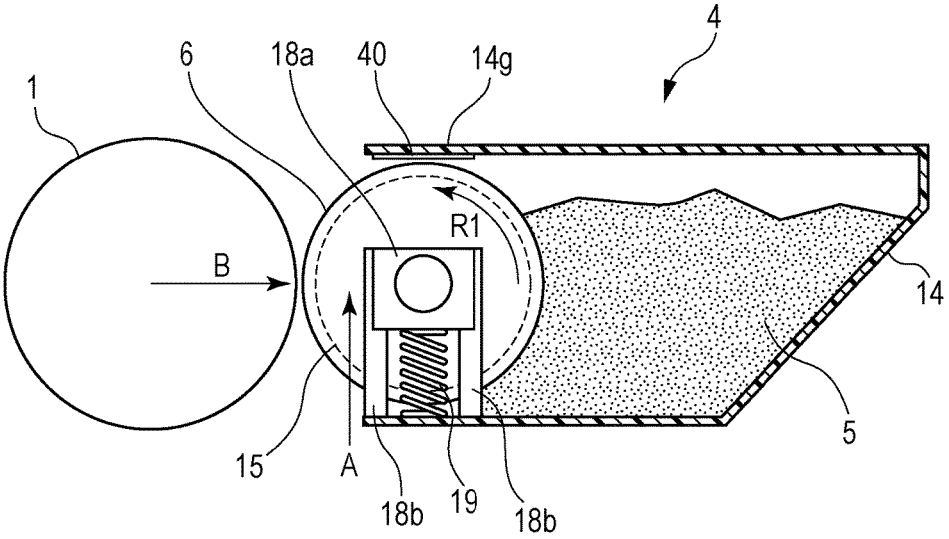
FIG. 9 is a cross-sectional view of a developing device.

A second embodiment will be described with reference to FIG. 9. While the developing-agent regulating portion 16 is a part of the developing container 14 and is provided integrally with the developing container 14 in the first embodiment, a sheet member 40 serving as a developing-agent regulating portion is attached to a developing container 14 in the second embodiment.

The sheet member 40 is formed by a urethane rubber sheet having a thickness of 0.5 mm and a surface roughness Ra of 0.1 micrometer. The sheet member 40 has a JIS-A hardness of 65 and a Young's modulus E of $3*10^6$ Pa. One surface of the sheet member 40 is attached to a ceiling plate 14*g* of the developing container 14 with a double-sided adhesive tape having a thickness of 0.1 mm. The other surface of the sheet member 40 is in contact with a developing sleeve 6 to regulate toner born on the developing sleeve 6. The sheet member 40 serving as the developing-agent regulating portion is clamped between the fixed ceiling plate 14*g* of the developing container 14 and the developing sleeve 6 at a contact portion in contact with the developing sleeve 6. Structures other than the sheet member 40 are similar to those adopted in the developing device 4 of the first embodiment.

Since the sheet member 40 is fixed with the surface, which is opposite the surface in contact with the developing sleeve 6, being supported by the ceiling plate 14*g*, even when the sheet member 40 is pressed by the developing sleeve 6, it does not move relative to the developing container 14. That is, on a downstream side of the contact portion between the sheet member 40 and the developing sleeve 6 in the pressurizing direction of the spring members 19 (on a back side of the contact portion), the fixed portion (ceiling plate 14*g*) of the developing container 14 is provided at no distance from the sheet member 40. Even when the sheet member 40 receives pressure from the spring members 19 by contact with the developing sleeve 6, a space that allows movement of the sheet member 40 is not provided on the downstream side of the sheet member 40 in the pressurizing direction. That is, the contact portion between the sheet member 40 and the developing sleeve 6 is fixed such as not to move relative to the developing container 14. Thus, the sheet member 40 can stably form a toner layer of a uniform thickness on the developing sleeve 6.

Since urethane rubber is more abrasion-resistant than HI-PS, durability of the process cartridge is enhanced. While urethane rubber is used as the material of the sheet member in the second embodiment, the material is not limited thereto when the developing-agent regulating portion is formed of a different material to increase abrasion resistance.

The sheet member 40 may be formed of a material that is different in chargeability to the toner from the material of the developing container 14.

For example, when the charge amount of toner excessively increases, the toner electrostatically coheres at the developing-agent regulating portion, and this sometimes makes it difficult to uniformly regulate the toner layer. When such a problem occurs, the sheet member 40 can be formed of polyphenylene sulfide resin (PPS). PPS is a material that is closer to the negative side in triboelectric series than HI-PS serving as the material of the developing container 14. That is, PPS is negatively charged when being rubbed against HI-PS. That is, PPS is less likely to charge the toner 5 to a negative polarity (normal polarity) than HI-PS.

In actuality, when a PPS sheet having a thickness of 100 micrometers and a surface roughness Ra of 0.1 micrometer was adopted as the sheet member 40, the charge amount (charge amount of per unit weight) of toner, which was born on the developing sleeve 6 after passing between the sheet member 40 and the developing sleeve 6, was 7 microC/g. This value is smaller than the charge amount of toner in the first embodiment.

When the developing-agent regulating portion is formed not only of PPS, but also of a material that is less likely to charge the toner than the material of the developing container 14, it is possible to suppress electrostatic cohesion and to avoid image failure. This applies not only to the case in which the developing-agent regulating portion is formed by the sheet member 40, but also to the case in which the developing-agent regulating portion is formed as a part of the developing container.

Conversely, to reliably charge the toner, the sheet member 40 is formed of a material that more easily charges the toner than the material of the developing container 14. Such a structure will be described in detail in conjunction with third and subsequent embodiments described below.

[Third Embodiment]

Figure 10A:
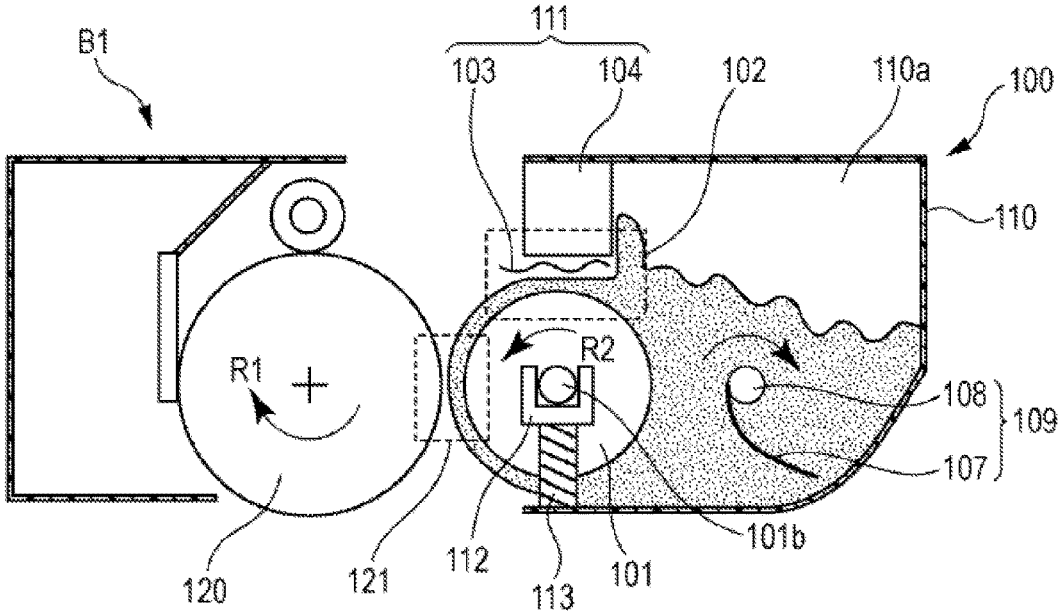
FIG. 10A is a cross-sectional view of a developing device.
Figure 10B:
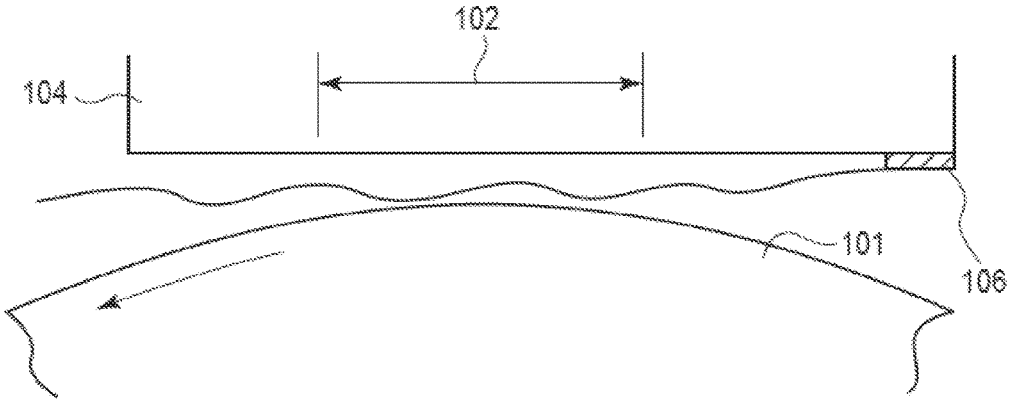
FIG. 10B is an enlarged view of a developing-agent regulation region.

A third embodiment of the present invention will be described with reference to the drawings. First, a developing device 100 adopted in the third embodiment will be described with reference to FIGS. 10A and 10B.

In the third embodiment, the developing device 100 is integrated with a photosensitive drum 120 to form a process cartridge B1. The process cartridge B1 is removably mounted in an apparatus body of an image forming apparatus.

The developing device 100 agitates toner stored in a developing container 110 by a rotating agitating member 109, and conveys the toner to a section near a developing roller 101 serving as a developing-agent bearing member. The agitating member 109 includes a rotating support member 108 rotatably supported by the developing container 110, and a flexible sheet 107 attached to the rotating support member 108. The flexible sheet 107 has a length such as to reach a bottom face of the developing container 110 so that toner does not accumulate on the bottom face.

The toner conveyed to the section near the developing roller 101 by the agitating member 109 is born on the developing roller 101. In the third embodiment, the developing roller 101 is a developing sleeve formed by an aluminum pipe, and has a magnet roller therein. The toner is magnetic toner, and is attracted onto the developing roller 101 by magnetic force generated by the magnet roller.

The amount of toner to be born on the developing roller 101 is uniformly regulated in a developing-agent regulating region 111, and a toner layer having a predetermined thickness is formed on the developing roller 101. In the third embodiment, the developing-agent regulating region 111 is formed by a sheet bearing surface 104 provided on the developing container 110 and a sheet member 103 attached to the sheet bearing surface 104.

The sheet bearing surface 104 is a fixing member that fixes the sheet member 103. The sheet member 103 is located at a position between the developing roller 101 and the sheet bearing surface 104, and is attached to the sheet bearing surface 104 with a double-sided adhesive tape 106. The sheet member 103 is actually in contact with the developing roller 101 to form a developing-agent regulating portion.

When the sheet member 103 in the developing-agent regulating region 111 contacts with the developing roller 101, the amount of toner born on the developing roller 101 is uniformly regulated, and a toner layer having a predetermined thickness is formed on the developing roller 101. At a regulation nip 102 where the developing roller 101 is in contact with the sheet member 103, a desired charge is imparted to the toner.

The charged toner on the developing roller 101 develops an electrostatic latent image formed on the photosensitive drum 120 in an opposing portion 121 where the photosensitive drum 120 opposes the developing roller 101. In a developing process of the third embodiment, a superimposed bias obtained by superimposing alternating-current voltage on direct-current voltage is applied to the developing roller 101. The charged toner is flown by an electric field, which is generated between the developing roller 101 and the photosensitive drum 120, in the opposing portion 121 while being out of contact with the developing roller 101 and the photosensitive drum 120.

Shaft portions 101*b* of the developing roller 101 are rotatably supported by bearing members (support portions) 112. The bearing members 112 are movable to change the distance between the developing roller 101 and the developing-agent regulating region 111. Spring members (elastic members) 113 serving as biasing members (pressurizing members) are attached to the bearing members 112 to pressurize the developing roller 101 toward the developing-agent regulating region 111.

By virtue of this structure, the toner regulation pressure and regulation position of the developing roller 101 can also be accurately maintained in the process cartridge B1 of the third embodiment.

As the material of the developing container 110, HI-PS employing styrene resin is adopted from viewpoints of shock resistance, material cost, and workability. The toner is obtained by granulating the same styrene resin as for the developing container 110 in order to restrict the toner from having unnecessary charge and electrostatically cohering in the developing container 110. This is to restrict conveyance performance of the toner from being reduced by cohesion of the toner in the developing container 110.

That is, in the third embodiment, materials that are unlikely to charge the toner are selected as the materials of the developing container 110 and the toner in order to prevent the toner from electrostatically cohering in a developing-agent storage chamber 110*a* of the developing container 110. However, to develop a latent image with the toner during image formation, there is a need to charge the toner born on the developing roller by the developing-agent regulating portion.

Particularly in an environment where the temperature and humidity are high and the toner is unlikely to be charged, it is necessary to sufficiently charge the toner by the developing-agent regulating portion. This is because, when the charge amount of toner decreases, the toner is not properly held on the developing roller. As a result, the toner may scatter from the developing roller and may contaminate the interior of the image forming apparatus.

Accordingly, in the third embodiment, the sheet member 103 provided in the developing-agent regulating region 111 is formed of a material that has a chargeability for the toner higher than that of the material of the developing-agent storage chamber 110*a*. In this case, even when the temperature and humidity environment changes, the toner to be born on the developing roller 101 is given an appropriate charge in order to suppress electrostatic cohesion of the toner and to prevent the toner from scattering from the developing roller 101.

Advantages of the third embodiment verified by experiment will be described below.

[Experimental Conditions]

As experimental conditions, the diameter of the developing roller 101 was set at 12 mm, and the diameter of the photosensitive drum 120 was set at 20 mm. The spring members 113 were adjusted such that the contact pressure with which the developing roller 101 contacted with the developing-agent regulating region 111 in the regulation nip 102 became 30 g/cm in linear pressure. Here, the linear pressure was measured by the following method.

First, three SUS sheets were inserted in the regulation nip 102 between the developing roller 101 and the developing-agent regulating region 111 in a state in which there was no toner therebetween, and a spring pressure F (fg) when the middle sheet was pulled out was measured. The SUS sheets had a thickness of 50 micrometers and a width of w cm. Then, a frictional coefficient u between the SUS sheets was measured. From these values, a linear pressure P was calculated according to a calculation expression P=uF/w.

As a condition that toner was born on the developing roller 101, a toner of 100 g was filled in the developing container 110, and the developing roller 101 was rotated for one minute at a number of revolutions (number of revolutions per minute) of 30 rpm.

Figure 11:
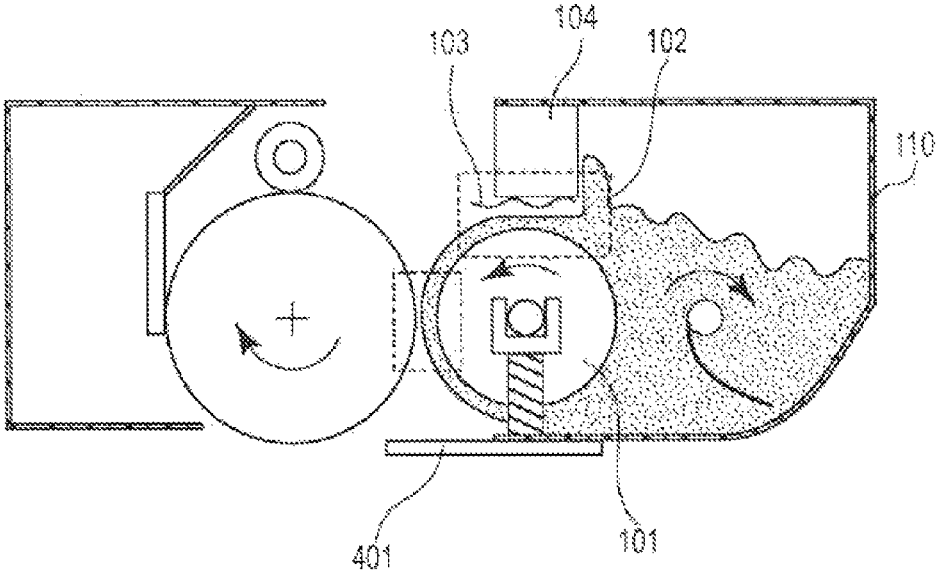
FIG. 11 is a cross-sectional view of the developing device.

After that, the charge amount per unit mass of the toner born on the developing roller 101 was measured with a coulomb meter and an electric balance. Further, to check the toner scattering in the apparatus, an OHP sheet 401 was stuck to the bottom of the developing container 110, and the presence or absence of toner falling down from the developing roller 101 was verified, as illustrated in FIG. 11.

[Measurement in Comparative Example]

Figure 12:
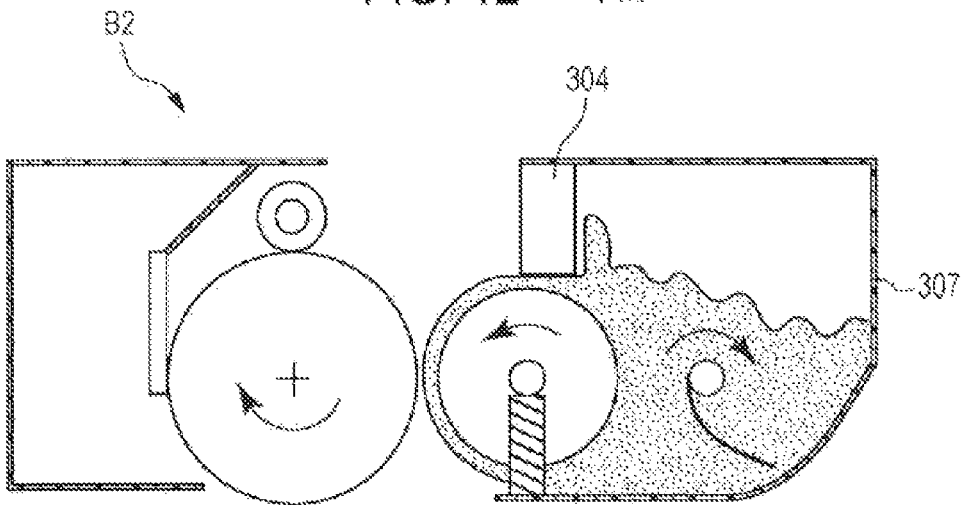
FIG. 12 Prior Art
FIG. 12 is a cross-sectional view of the developing device.

First, as a comparative example with the third embodiment, an experiment was conducted using a process cartridge B2 illustrated in FIG. 12. In the process cartridge B2, a developing-agent regulating portion 304 is formed of the same HI-PS material as that for a developing container 307. Other structures are similar to those adopted in the process cartridge B1 of the third embodiment.

Table 1 shows a result of the experiment conducted with the process cartridge B2. As shown in Table 1, the charge amount and fall of toner were checked in the following three typical temperature and humidity conditions:

Condition 1: temperature 15 deg C (degrees Celsius), humidity 10%

Condition 2: temperature 23 deg C, humidity 60%

Condition 3: temperature 32 deg C, humidity 80%.

The unit of charge amount of toner is microC/g. As criteria for judging the presence or absence of a toner fall, "A" indicates that a toner fall was not found, and "B" indicates that a toner fall was found.

TABLE 1

| | Condition 1 (15 deg C., 10%) | | Condition 2 (23 deg C., 60%) | | Condition 3 (32 deg C., 80%) | |
|---|---|---|---|---|---|---|
| | Charge Amount of Toner [microC/g] | Toner Fall | Charge Amount of Toner [microC/g] | Toner Fall | Charge Amount of Toner [microC/g] | Toner Fall |
| Comparative Example (FIG. 3) | −8 | A | −5 | A | −2 | B |

A: TONER FALL NOT FOUND
B: TONER FALL FOUND

As a result of the experiment, it was found that the charge amount varied according to the temperature and humidity condition. Further, it was found that the fall of toner occurred or did not occur according to the temperature and humidity condition. Also, it was found that a threshold value of a toner fall existed between the charge amounts of toner of −5 microC/g and −2 microC/g. Table 1 shows that the triboelectric charge amount of toner on the developing roller and the toner fall have tendencies.

That is, in the process cartridge B2 of the comparative example, the toner was sufficiently charged and did not fall from the developing roller in Condition 1 (low temperature and low humidity: temperature 15 deg C, humidity 10%) and Condition 2 (normal temperature and normal humidity: temperature 23 deg C, humidity 60%). In contrast, in Condition 3 (high temperature and high humidity: temperature 32 deg C, humidity 80%), the charge amount of toner tended to decrease, and the toner sometimes fell from the developing roller.

[Measurement in Third Embodiment]

Accordingly, in view of the above-described result, the sheet member 103 serving as the developing-agent regulating portion in the process cartridge B1 of the third embodiment is formed of a material that more easily charges the toner to a negative polarity (normal polarity) than the material of the developing container 110, as described above. That is, the sheet member 103 is formed of a material that is closer to the positive polarity side than the material of the developing container 110 in triboelectric series, and has a property of being charged to a positive polarity when being rubbed against HI-PS that forms the developing container 110.

The positively charged sheet member 103 charges the toner born on the developing roller 101 to a negative polarity.

In actuality, as the sheet member 103, a sheet formed of polycarbonate (PC), a sheet formed of polyethylene terephthalate (PET), and a metallic sheet (formed of stainless steel (SUS) in the third embodiment) were used. Each of these sheet members 103 was subjected to an experiment while being located between the developing roller 101 and the sheet bearing surface 104.

Table 2 shows results of experiments conducted on the sheet members 103 formed of the above-described materials in the process cartridge B1 of the third embodiment. Comparison of Table 1 and Table 2 shows that the triboelectric charge amount of toner could be made larger than in the comparative example by setting the sheet member 103 that easily charges the toner in the developing-agent regulating portion. Further, it could be verified that a toner fall did not occur even in the high temperature and high humidity condition because the triboelectric charge amount was increased.

TABLE 2

| | Condition 1 (15 deg C., 10%) | | Condition 2 (23 deg C., 60%) | | Condition 3 (32 deg C., 80%) | |
|---|---|---|---|---|---|---|
| Type of Sheet Member | Charge Amount of Toner [microC/g] | Toner Fall | Charge Amount of Toner [microC/g] | Toner Fall | Charge Amount of Toner [microC/g] | Toner Fall |
| PC | −15 | A | −10 | A | −5 | A |
| PET | −30 | A | −20 | A | −10 | A |
| SUS | −45 | A | −30 | A | −15 | A |

A: TONER FALL NOT FOUND
B: TONER FALL FOUND

As described above in conjunction with the third embodiment, an appropriate charge could be imparted to the toner and toner scattering could be further suppressed by providing, in the developing-agent regulating portion, the sheet member that more easily charged the toner to a negative polarity (normal polarity of toner during image formation) than the developing container.

[Modifications]

Figure 13A:
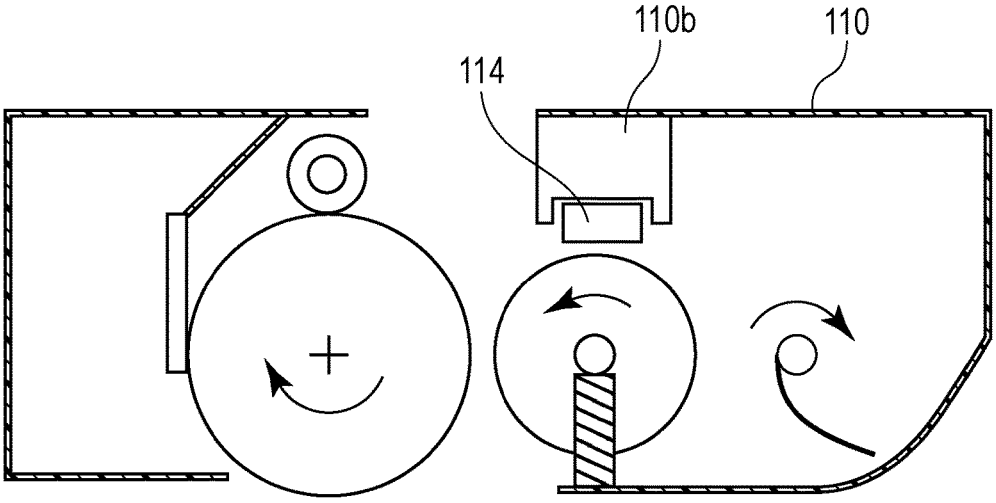
FIG. 13A is a cross-sectional view of the developing device.
Figure 13B:
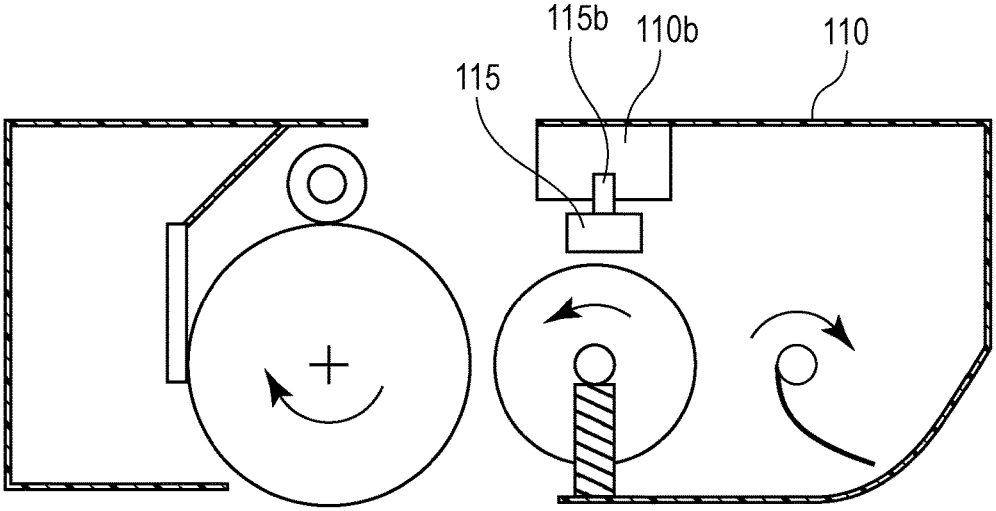
FIG. 13B is a cross-sectional view of the developing device.

FIGS. 13A and 13B illustrate two modifications of the third embodiment. A modification illustrated in FIG. 13A is characterized in that a developing-agent regulating member 114 serving as a developing-agent regulating portion is fixedly fitted in a bearing surface (fixing portion) 110*b* of a developing container 110. A modification illustrated in FIG. 13B is characterized in that a developing-agent regulating portion 115 is fixed to a fixing portion 110*b*. The developing-agent regulating member 114 is located at a position between a developing roller 101 and the bearing surface 110*b*. That is, the developing-agent regulating member 114 is supported by the fixing portion 110*b* on a side opposite a contact portion with the developing roller 101. The developing-agent regulating portion 115 is fixed with a fixed portion 115*b*, which is provided on a side opposite a contact portion with the developing roller 101, being fitted in the fixing portion 110*b*.

The developing-agent regulating members 114 and 115 are formed of a material that is closer to the positive side in triboelectric series than the material of the developing container 110 (a material that is likely to be charged to a positive polarity), and easily charge the toner to a negative polarity (normal polarity of toner during image formation).

The developing-agent regulating members 114 and 115 provided as the developing-agent regulating portions in the modifications have rigidity, and positions where the developing-agent regulating members 114 and 115 regulate the developing agent is more stable than the position of the flexible sheet member 103 (see FIG. 10).

The above-described structures are just exemplary, and the present invention is not limited thereto. For example, the sheet member 103 is formed of a material that easily charges the toner to a negative polarity in the third embodiment. This is because the image forming system used in the third embodiment forms an image while charging the toner to a negative polarity. In an image forming system that uses toner charged with a positive polarity for image formation, a similar advantage can be obtained by selecting a sheet member that more easily charges the toner to a positive polarity than the developing container.

To reliably charge the toner to a normal polarity by the developing-agent regulating portion, it is satisfactory that the developing-agent regulating portion is more likely to be charged to a polarity opposite the normal polarity of the toner than the developing-agent storage chamber of the developing container. That is, it is satisfactory that the developing-agent regulating portion is formed of a material that is closer to the polarity side opposite the normal polarity of the toner than the material of the developing-agent storage chamber.

[Fourth Embodiment]

In the third embodiment, the sheet member or the like that easily applies a triboelectric charge amount to the toner is used in the developing-agent regulating portion. This can more efficiently charge the toner than when the toner is charged only by the contact between the frame of the developing container and the developing roller.

In contrast, in a fourth embodiment, a developing-agent regulating portion and a developing container are integrally molded by two-color molding or insert molding, instead of fixing a member of a different material to the developing container. This structure will be described. The fourth embodiment can also provide a developing device and a process cartridge that properly charge toner in a developing-agent regulating portion.

First, the structure adopted in the fourth embodiment will be described with reference to FIGS. 14A to 14D, FIGS.

Figure 16:
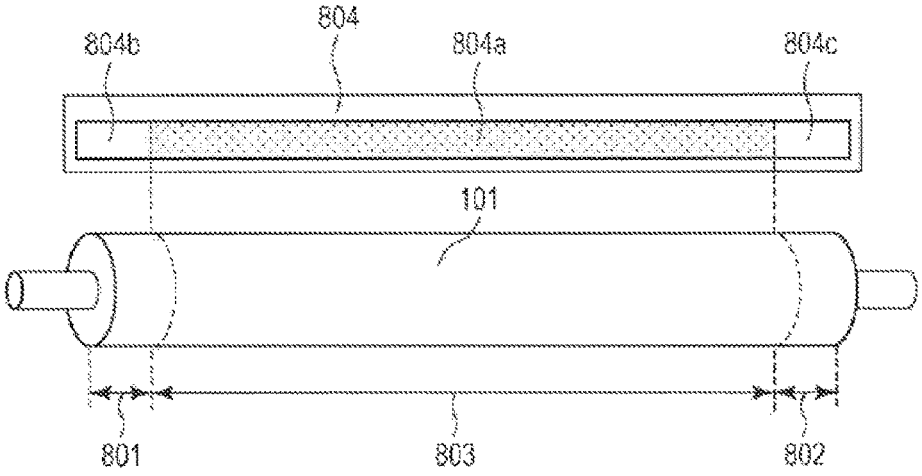
FIG. 16 illustrates a developing-agent regulating portion.

15A to 15F, and FIG. 16. Descriptions of components having structures similar to those adopted in the third embodiment are skipped.

Figure 14A:
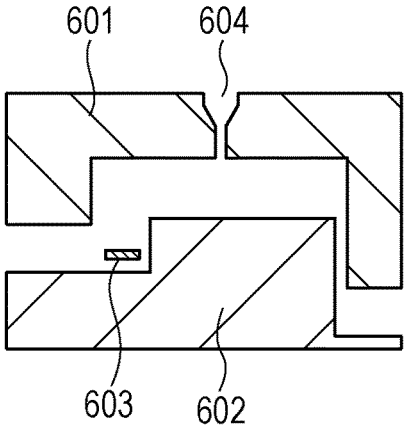
FIG. 14A illustrates insert molding.

FIGS. 14A to 14D illustrate a molding method called insert molding. As illustrated in FIG. 14A, an insert member 603 to be a developing-agent regulating portion is set on an inner side of a mold 601 and a mold 602. In the fourth embodiment, an SUS sheet formed by a metal sheet is set as the insert member 603 as an example.

The mold 601 has an injection port 604 from which resin or the like is injected in the molds. The position of the injection port 604 is not limited to a position illustrated in FIGS. 14A to 14C. The position and number of the injection port 604 can be optimized according to the viscosity of resin to be injected and the size of a member to be molded.

Figure 14B:
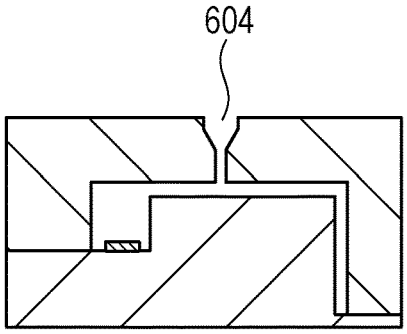
FIG. 14B illustrates insert molding.
Figure 14C:
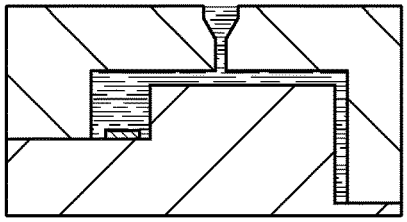
FIG. 14C illustrates insert molding.
Figure 14D:
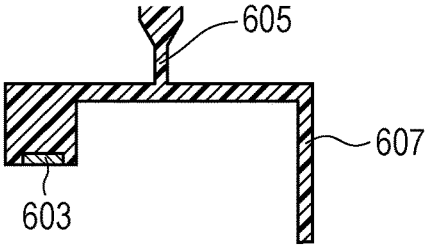
FIG. 14D illustrates insert molding.

As illustrated in FIG. 14B, the insert member 603 is set, the mold 601 and the mold 602 are matched and heated to an extent such that resin to be injected can sufficiently flow in the molds, and the resin is injected from the injection port 604. When the resin is sufficiently injected, as illustrated in FIG. 14C, the mold 601 and the mold 602 are separated again while being cooled. At this time, an insert-molded resin member is separated from the molds, so that a member to be a developing container and a developing-agent regulating portion can be obtained in a near net shape (FIG. 14D). After that, an unnecessary portion 605, such as a remaining portion corresponding to the injection port, is cut off, and a final molding is obtained. By thus using insert molding, the developing-agent regulating portion formed by the insert member 603 is molded integrally with a frame 607 of the developing container.

In contrast, the developing-agent regulating portion can be molded by a molding method called two-color molding or double molding, as illustrated in FIGS. 15A to 15F.

Figure 15A:
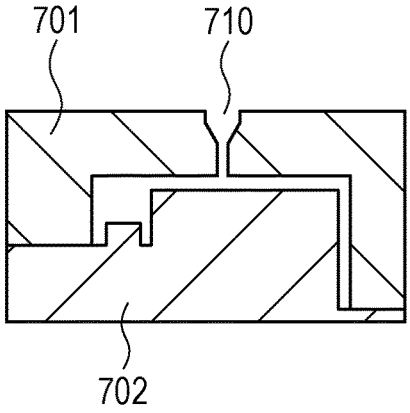
FIG. 15A illustrates double molding.
Figure 15B:
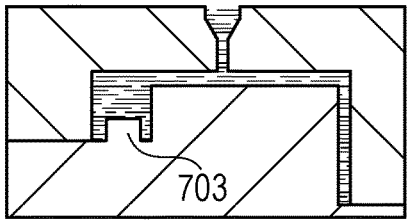
FIG. 15B illustrates double molding.
Figure 15C:
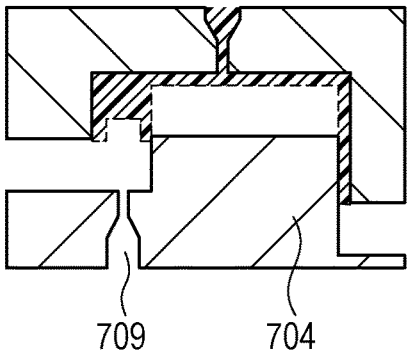
FIG. 15C illustrates double molding.
Figure 15D:
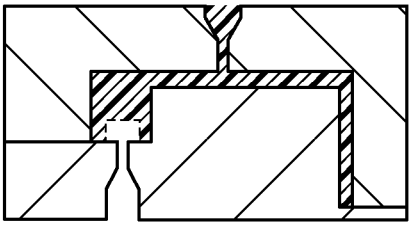
FIG. 15D illustrates double molding.
Figure 15E:
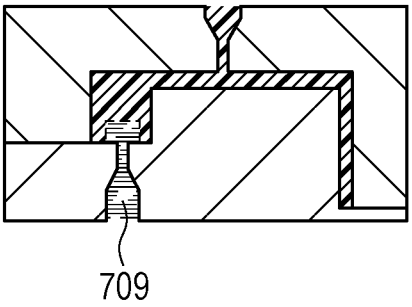
FIG. 15E illustrates double molding.

A mold 701 and a mold 702 are matched, as illustrated in FIG. 15A, and resin is injected from an injection port 710, as illustrated in FIG. 15B. At this time, a first molding formed by the mold 701 and the mold 702 is obtained without a portion to be formed of a different material (a portion to be a developing-agent regulating portion) 703. Then, the mold 702 is removed, as illustrated in FIG. 15C, and a mold 704 that allows resin to be injected only in the portion to be the developing-agent regulating portion is matched with the mold 701, as illustrated in FIG. 15D. After that, a resin different from the resin injected from the injection port 710 is injected from an injection port 709, as illustrated in FIG. 15E.

Figure 15F:
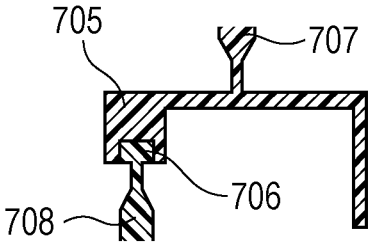
FIG. 15F illustrates double molding.

A molding thus obtained is molded from two kinds of resins, that is, resin 705 that forms a developing-agent storage chamber of the developing container and resin 706 that forms the developing-agent regulating portion (see FIG. 15F).

The obtained molding can be given a net shape by cutting off unnecessary portions 707 and 708 remaining in the injection ports. In this way, the developing-agent regulating portion (resin 706 of FIG. 15F) and the developing container (resin 705 of FIG. 15F) can also be integrally molded by two-color molding.

For easy explanation, in the mold 704 used in the fourth embodiment, the injection port 709 is set at the position where a contact surface of the developing-agent regulating portion with a developing roller is to be formed. However, since the contact surface with the developing roller is an important portion for uniformly coating the developing roller with a toner layer, it requires high surface accuracy. For this reason, the setting position of the injection port 709 is provided apart from the contact surface of the developing-agent regulating portion.

The fourth embodiment will be described below by taking, as an example, a case in which a developing container and a developing-agent regulating portion are molded by two-color molding illustrated in FIGS. 15A to 15F.

In the fourth embodiment, polyethylene terephthalate (PET) resin is selected as the resin 706 that forms the developing-agent regulating portion. Further, high-impact polystyrene (HI-PS) is selected as the resin 705 that forms a main part of the developing container (a portion to be the developing-agent storage chamber). That is, the developing-agent regulating portion of the developing container is formed of a material that is closer to the positive polarity side in triboelectric series and more easily charges toner to a negative polarity (normal polarity) than the developing-agent storage chamber.

Table 3 shows the charge amount of toner and the presence or absence of a toner fall in the fourth embodiment. An experimental method in the fourth embodiment is similar to that adopted in the above-described third embodiment.

For reference, Table 3 also shows an experimental result of the structure using the sheet member of PET in the developing-agent regulating portion (structure of the third embodiment illustrated in FIG. 5), in addition to an experimental result of the fourth embodiment.

TABLE 3

| | Condition 1 (15 deg C., 10%) | | Condition 2 (23 deg C., 60%) | | Condition 3 (32 deg C., 80%) | |
|---|---|---|---|---|---|---|
| | Charge Amount of Toner [microC/g] | Toner Fall | Charge Amount of Toner [microC/g] | Toner Fall | Charge Amount of Toner [microC/g] | Toner Fall |
| Fourth Embodiment (Two-Color Molding) | −30 | A | −20 | A | −10 | A |
| Third Embodiment (Sheet Member) | −30 | A | −20 | A | −10 | A |

A: TONER FALL NOT FOUND
B: TONER FALL FOUND

The fourth embodiment could obtain the result similar to that of the structure of the third embodiment (the structure using the sheet member of PET in the developing-agent regulating portion). That is, when the developing-agent regulating portion was formed by two-color molding, an advantage sufficient to properly subject the toner to triboelectric charging was also obtained.

Further, since the developing-agent regulating portion is compatibly fixed to the frame of the developing container in the fourth embodiment, it can be set stably.

[Fifth Embodiment]

The third and fourth embodiments obtain the above-described advantages and methods by changing the material of the developing-agent regulating portion to the material that easily charges the toner.

To develop the structures of the third and fourth embodiments, a fifth embodiment aims to reliably avoid image failure by suppressing excessive charging of toner.

When a large number of recording sheets (recording media) are printed in a short time in a low-temperature and low-humidity environment, toner may stick to end margins of the recording sheets. This is because the toner located at longitudinal end portions of a developing roller is rarely used for image formation, but continues to be charged. That is, when the toner is excessively charged at the end portions of the developing roller, it may be transferred from the developing roller to a non-image forming region on a photosensitive drum (a region where a toner image is not to be formed), and may finally stick to the recording sheets.

In particular, seal members are in contact with the end portions of the developing roller to fill a gap between the developing container and the developing roller so that developing agent does not leak out from the developing container. The toner is rarely used for image formation on outer sides of positions where the seal members are in contact with the developing roller. That is, when the toner is born on the developing roller on the outer sides of the seal members, it continues to be born and is apt to be charged excessively.

Accordingly, in the fifth embodiment, regions of a developing-agent regulating portion in contact with the end portions of the developing roller are formed of a material that less easily charges toner than a material of a region of the developing-agent regulating portion in contact with the center portion of the developing roller. This properly controls the charge given to the toner by the developing-agent regulating portion and suppresses excessive charging of the toner born on the end portions of the developing roller.

A developing-agent regulating portion 804 in the fifth embodiment will be described below with reference to FIG. 16. In the fifth embodiment, a center portion 804*a* of the developing-agent regulating portion 804 in a longitudinal direction of a developing roller 101 is formed of PET, and end portions 804*b* and 804*c* of the developing-agent regulating portion 804 in the longitudinal direction are formed of the same HI-PS as that for a developing-agent storage chamber.

A center region 803 of the developing roller 101 in the longitudinal direction serves as a toner supply region to which toner is supplied from the developing-agent storage chamber.

Seal members (not illustrated) are in contact with opposite ends of the toner supply region 803 of the developing roller 101. Further, end regions 801 and 802 of the developing roller 101 are provided on outer sides of positions where the seal members are in contact with the developing roller 101.

Toner is not supplied from the developing container to the end regions 801 and 802 on the outer sides of the toner supply region 803, and little toner is born thereon. However, once toner is born on the end regions 801 and 802, it is sometimes charged excessively.

Accordingly, as illustrated in FIG. 16, the center portion 804*a* of PET of the developing-agent regulating portion 804 is in contact with the toner supply region 803, while the end portions 804*b* and 804*c* of HI-PS of the developing-agent regulating portion 804 are in contact with the end regions 801 and 802, respectively. HI-PS is closer to the negative polarity side than PET in triboelectric series. That is, HI-PS less easily charges the toner to a negative polarity than PET, and thus can restrict the toner from being excessively charged in the end regions of the developing roller. This suppresses a phenomenon in which the excessively charged toner sticks to ends of a recording sheet.

Advantages of the fifth embodiment were verified by a test. A result of the test will be described below. In the test, a process cartridge employing the above-described developing-agent regulating portion 804 was mounted in an image forming apparatus, and images were successively printed on recording sheets by the image forming apparatus. The printed recording sheets were checked to determine whether or not toner stuck to end portions of the recording sheets.

As operating conditions of the image forming apparatus, a process speed at which a photosensitive drum was rotated was set at a peripheral speed of 200 mm/sec, and an image print speed was set such that images were printed on 30 recording sheets per minute. A4-sized sheets were used as the recording sheets, and the resolution of printed images was set at 600 dpi such that horizontal lines having a width of four dots were arranged at a pitch of 100 dots. The ratio of an image print region to a recording sheet, that is, a printing rate was 4%.

Table 4 shows a result of determination whether or not toner stuck to end portions of successively printed recording sheets, which determination was performed every time a predetermined number of sheets were printed. In Table 4, "A" indicates that toner sticking to the recording sheets was not found, and "B" indicates that toner sticking to the recording sheets was found.

Figure 17:
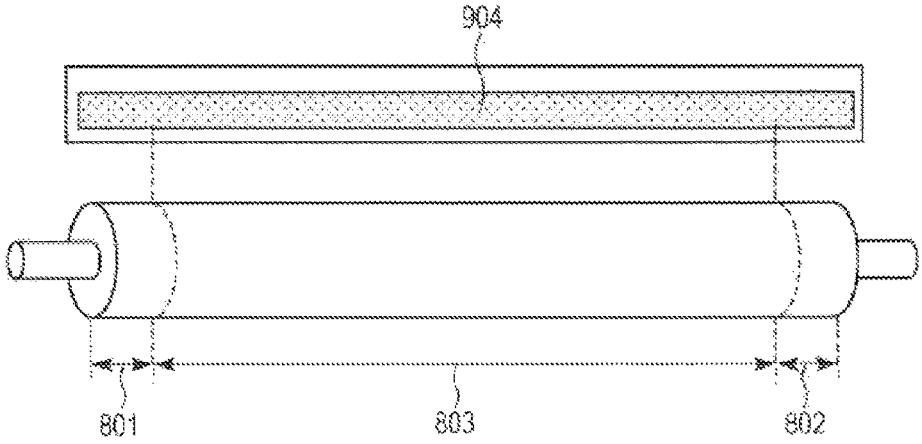
FIG. 17 Prior Art
FIG. 17 illustrates the developing-agent regulating portion.

As a comparative example with the fifth embodiment, a test was conducted in a similar condition using a process cartridge in which a developing-agent regulating portion 904 is entirely formed of PET, as illustrated in FIG. 17. Table 4 also shows a result of the test in addition to the test result of the fifth embodiment.

TABLE 4

| | | Number of Prints | | | | | | | |
|---|---|---|---|---|---|---|---|---|---|
| | | 200 | 400 | 600 | 800 | 1200 | 1400 | 1600 | 1800 |
| Toner Sticking to Recording Sheet | Comparative Example | A | A | A | A | A | A | B | B |
| | Fifth Embodiment | A | A | A | A | A | A | A | A |

A: TONER STICKING NOT FOUND
B: TONER STICKING FOUND

As shown in Table 4, in the comparative example in which the developing-agent regulating portion 904 (see FIG. 17) was entirely formed of PET, when 1600 or more recording sheets were successively printed, toner sticking (transfer) to end portions of the recording sheets was found. In contrast, in the fifth embodiment (see FIG. 16), toner sticking to recording sheets was avoided during printing of 1800 recording sheets.

Table 5 shows charge amounts of toner born on the center and end portions of the developing roller that were measured before the test and after 1200 recording sheets are printed.

TABLE 5

| | Toner Charge Amount Before Test [microC/g] | | Toner Charge Amount After 1200 Prints were Made [microC/g] | |
|---|---|---|---|---|
| | Developing Roller Center | Developing Roller End | Developing Roller Center | Developing Roller End |
| Comparative Example | −30 | −30 | −30 | −60 |
| Fifth Embodiment | −30 | −25 | −30 | −30 |

Table 5 shows that the charge amount of toner born on the end portions of the developing roller significantly increased by printing 1200 recording sheets in the comparative example. In contrast, in the fifth embodiment, the charge amount of toner born on the end portions of the developing roller hardly changed before the test and after 1200 recording sheets were printed. Further, it could be confirmed that the obtained charge amount in the end portions was equivalent to that in the center portion of the developing roller.

The structure of the fifth embodiment is just exemplary. While PET and HI-PS are used in combination as the materials of the developing-agent regulating portion, the present invention is not limited thereto. For example, when the center portion of the developing-agent regulating portion is formed of PC in the developing container including the developing-agent storage chamber formed of HI-PS, it is also effective to form the end portions of the developing-agent regulating portion of PET that has a toner chargeability lower than that of PC.

That is, the end portions of the developing-agent regulating portion can be formed of a material that is closer to the normal polarity side of toner in triboelectric series than the material of the center portion of the developing-agent regulating portion.

The material of the developing-agent regulating portion may be changed at any position that does not have any influence on images. While the positions of the center portion 804*a* and the end portions 804*b* and 804*c* are determined with reference to A4-sized recording sheets adopted in the fifth embodiment, the present invention is not limited thereto.

[Sixth Embodiment]

A sixth embodiment will be described below.

In the above-described first and other embodiments, the developing-agent bearing member is movable relative to the developing container. Hence, there is a probability that the developing-agent bearing member will rock with rotation and an axis of the developing-agent bearing member will tilt relative to the designed direction. If the developing-agent bearing member thus rocks, the longitudinal end portions of the developing-agent bearing member shift from the positions where the developing-agent regulating portion is provided. As a result, stable regulation of the developing agent may become difficult in the end portions of the developing-agent bearing member, and fogging and image density unevenness sometimes occur in both ends of images.

Accordingly, in the structure in which the developing-agent bearing member is movable relative to the developing container and is pressed against the developing-agent regulating portion to regulate the developing agent on the developing-agent bearing member, it is important to suppress rock of the developing-agent bearing member. The sixth embodiment adopts a movement restricting portion 30 that restricts rock of the developing-agent bearing member. In the following, structures similar to those adopted in the first embodiment are denoted by similar reference numerals, and detailed descriptions thereof are skipped.

Figure 18:
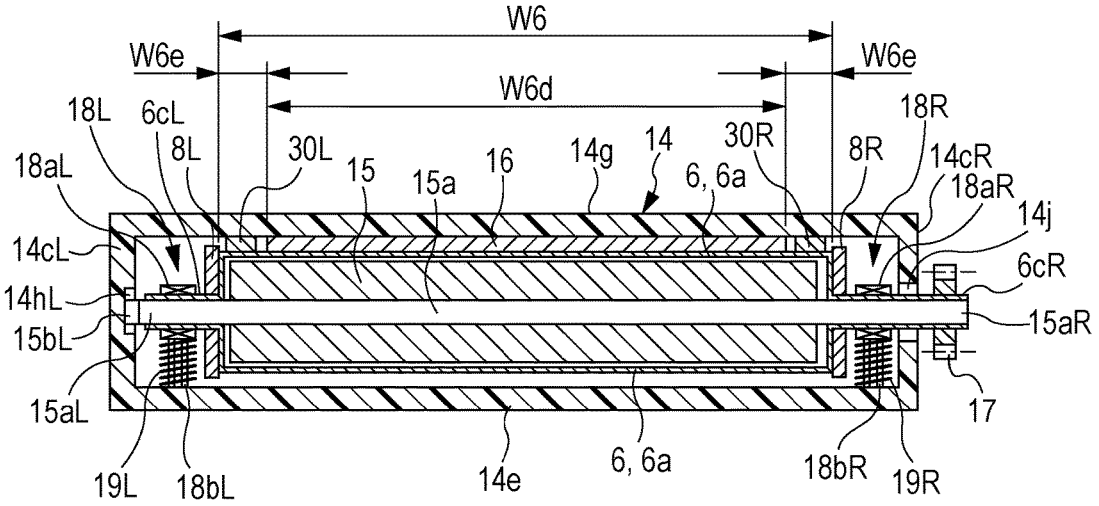
FIG. 18 is a cross-sectional view of a developing device.
Figure 19:
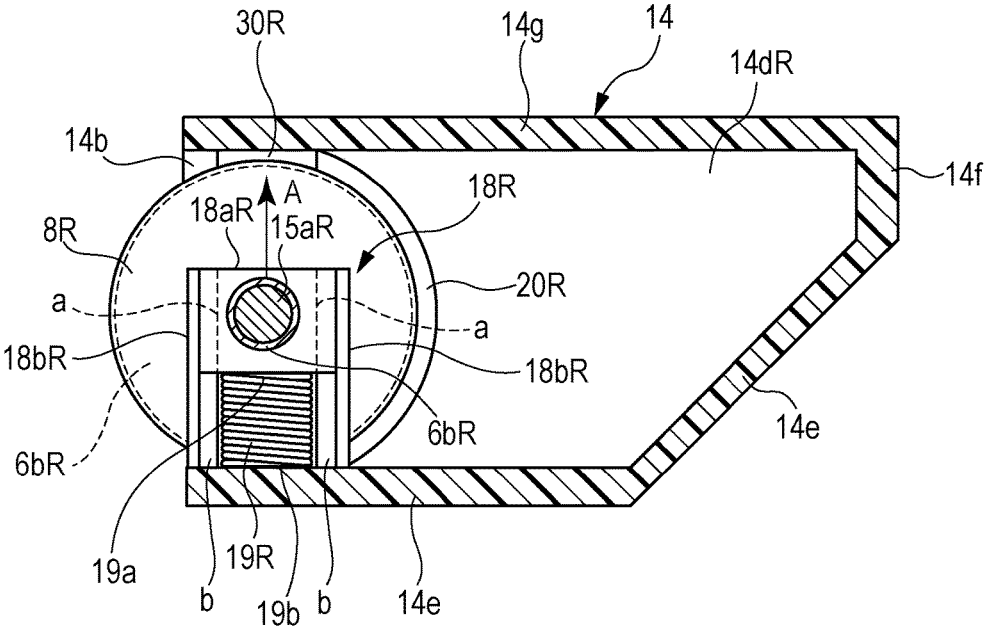
FIG. 19 is a cross-sectional view of the developing device.
Figure 20A:
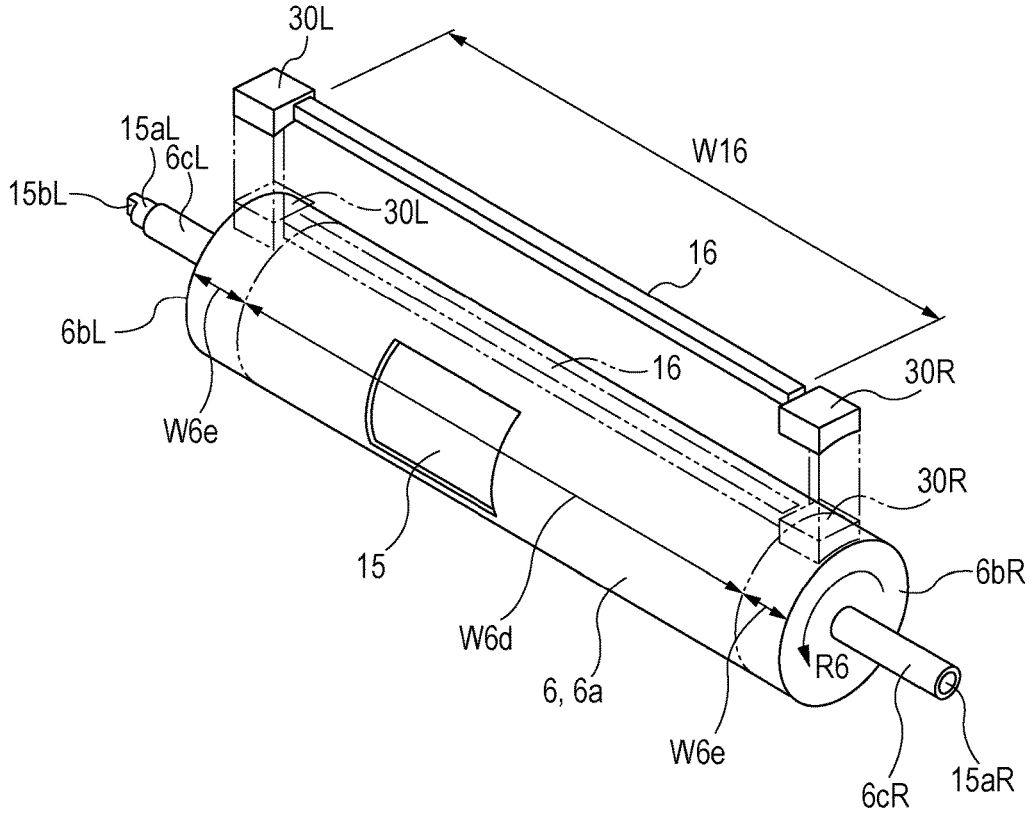
FIG. 20A illustrates a movement restricting portion.
Figure 20B:
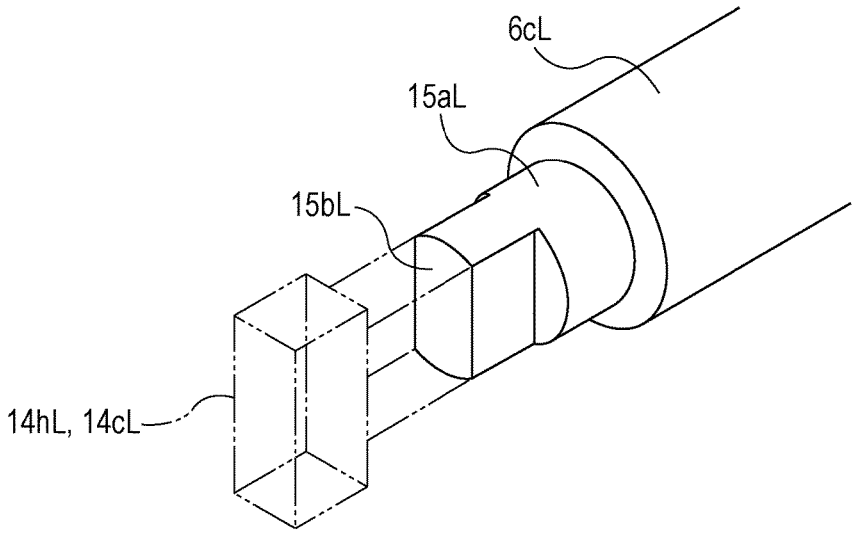
FIG. 20B illustrates a magnet roller.

FIG. 18 is a sectional view (longitudinal sectional front view), taken along line XVIII-XVIII of FIG. 3, and FIG. 19 is a sectional view (transverse sectional left side view), taken along line XIX-XIX of FIG. 3. FIG. 20A is a partly cutaway perspective view of an assembly of a developing sleeve 6 and a magnet roller 15, and FIG. 20B is an enlarged partial perspective view of the assembly of FIG. 20A. FIG. 20A also illustrates a developing-agent regulating portion 16 and left and right movement restricting portions 30L and 30R that restrict opposite end portions of the developing sleeve 6 (one end portion and the other end portion in an axial direction of the developing sleeve 6) which will be described below. The magnet roller 15 has an outer diameter slightly smaller than an inner diameter of a sleeve portion 6*a*. Left and right axial end portions 15*a*L and 15*a*R of a shaft portion 15*a* of the magnet roller 15 extend through left and right shaft portions 6*c*L and 6*c*R of the developing sleeve 6, respectively. An outer diameter of the axial end portions 15*a*L and 15*a*R is substantially equal to an inner diameter of the shaft portions 6*c*L and 6*c*R, and the shaft portions 6*c*L and 6*c*R are rotatably supported on the axial end portions 15*a*L and 15*a*R. That is, the developing sleeve 6 is coaxially rotatable around the magnet roller 15.

As illustrated in FIG. 20B, the left axial end portion 15*a*L of the shaft portion 15*a* protrudes outward from the left shaft portion 6*c*L. The protruding end portion of the axial end potion 15*a*L is provided with a key 15*b*L. The key 15*b*L of the axial end portion 15*a*L protruding outward from the left shaft portion 6*c*L is fitted in a key groove 14*h*L extending in the up-down direction and provided in an inner surface of a left side plate 14*c*L of a developing container 14. The right shaft portion 6*c*R protrudes outward from a right side plate 14*c*R of the developing container 14 through a slot 14*j* (FIG. 18) extending in the up-down direction and provided in a right side plate 14*c*R. A drive gear 17 is concentrically provided on the protruding shaft portion 6*c*R.

Figure 21:
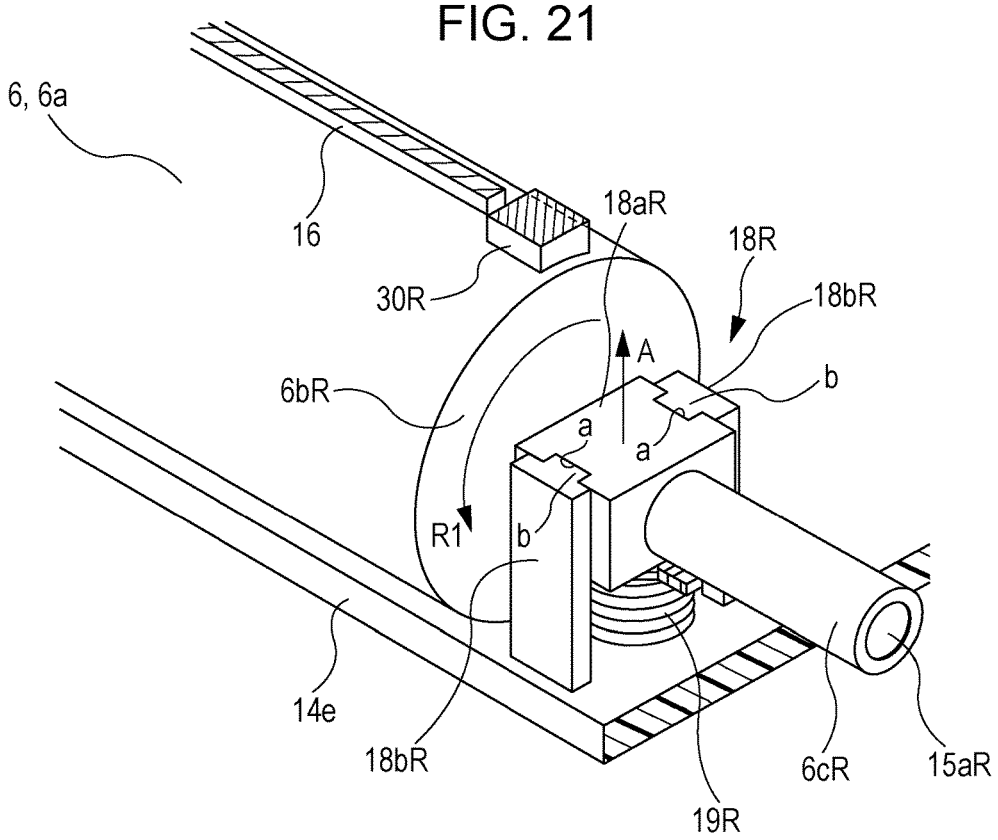
FIG. 21 illustrates a bearing member.

FIG. 21 is a perspective view of a right bearing mechanism 18R. The key 15*b*L of the axial end portion 15*a*L protruding outward from the left shaft portion 6*c*L is fitted in the key groove 14*h*L extending in the up-down direction and provided in the inner surface of the left side plate 14*c*L of the developing container 14. The right shaft portion 6*c*R protrudes outward from the right side plate 14*c*R of the developing container 14 through the slot 14*j* extending in the up-down direction and provided in the right side plate 14*c*R. Therefore, the developing sleeve 6 including the magnet roller 15 is allowed to move in the up-down direction in a state in which rotation of the magnet roller 15 is stopped. By rotating force transmitted to the drive gear 17, the developing sleeve 6 can be rotated around the magnet roller 15 that does not rotate.

Similarly to the first embodiment, both left and right end portions of the developing sleeve 6 extending in the axial direction are supported by left and right movable bearing members 18*a*L and 18*a*R that are slidable in the up-down direction along guide members 18*b*L and 18*b*R, respectively. By biasing the left and right movable bearing members 18*a*L and 18*a*R upward by spring members 19L and 19R, the developing sleeve 6 can be moved in a direction A to pressurize the developing sleeve 6 toward the developing-agent regulating portion 16.

For this reason, some gap (play) is needed in fitting portions between the bearing members 18*a*L and 18*a*R and the guide members 18*b*L and 18*b*R of the developing container. While design is made to minimize this gap, the gap sometimes becomes comparatively large due to dimensional variations of components.

Figure 22:
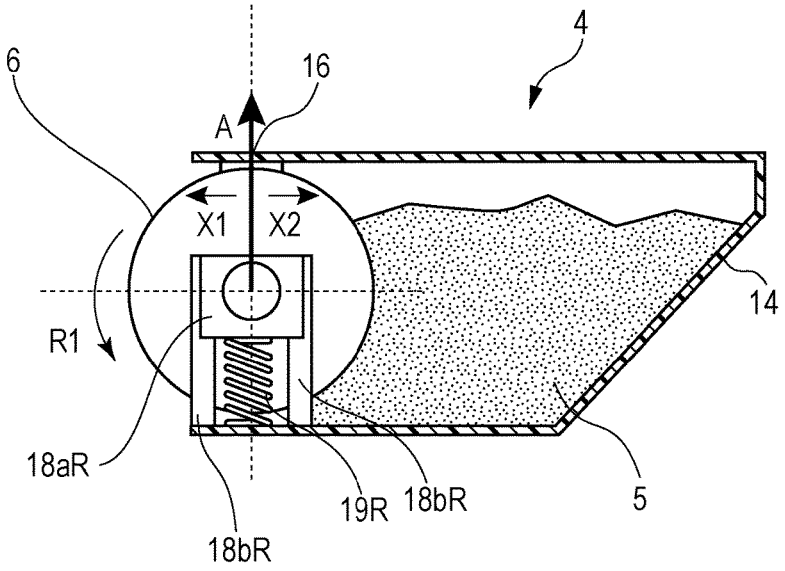
FIG. 22 is a cross-sectional view of the developing device.
Figure 23:
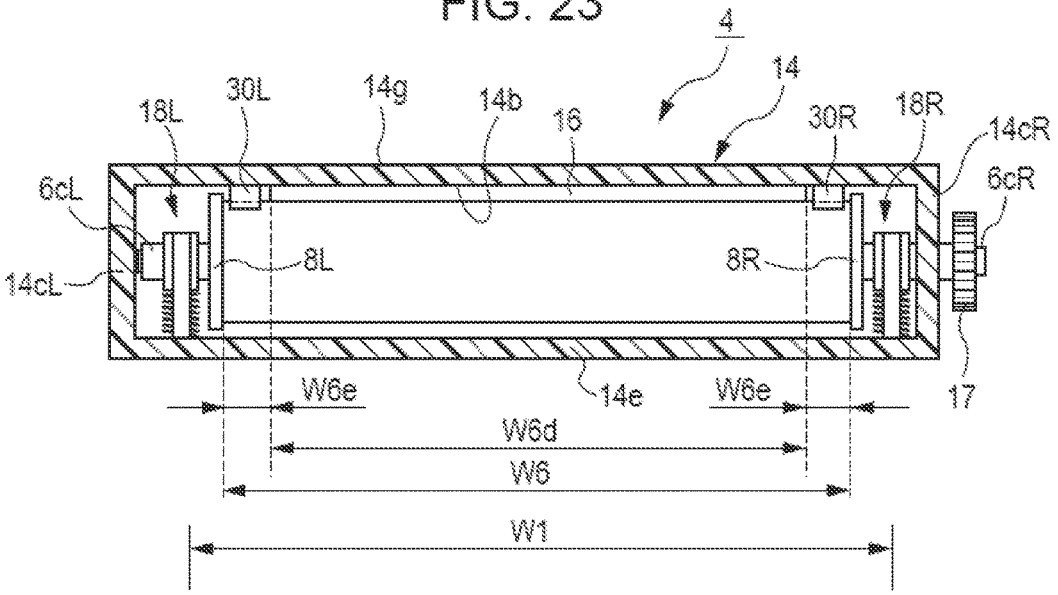
FIG. 23 is a sectional view of the developing device.

Because of this play, the developing sleeve 6 sometimes rocks in X1- and X2-directions (directions intersecting the direction of arrow A in a plane orthogonal to the axis of the developing sleeve 6 (FIG. 22)) during rotation, as schematically illustrated in FIG. 22. If the developing sleeve 6 rocks, in particular, longitudinal end portions of the developing sleeve 6 move from the position where the developing-agent regulating portion 16 is provided. As a result, regulation of the toner 5 becomes unstable in the longitudinal end portions of the developing sleeve 6, and the amount of toner 5 on the developing sleeve 6 increases. This causes fogging and density unevenness in end portions of images, which sometimes deteriorates image quality.

Accordingly, in the sixth embodiment, movement restricting portions 30L and 30R for restricting the longitudinal end portions of the developing sleeve 6 from rocking (moving) are provided in the developing container 14 of the developing device 4, as illustrated in FIGS. 18, 20, 21, and 23. In this case, even if there is play in the fitting portions between the movable bearing members 18*a*L and 18*a*R and the guide members 18*b*L and 18*b*R of the developing container 14, rock of the developing sleeve 6 can be suppressed. As a result, the amount of toner 5 born on the developing sleeve 6 is stabilized.

Figure 24:
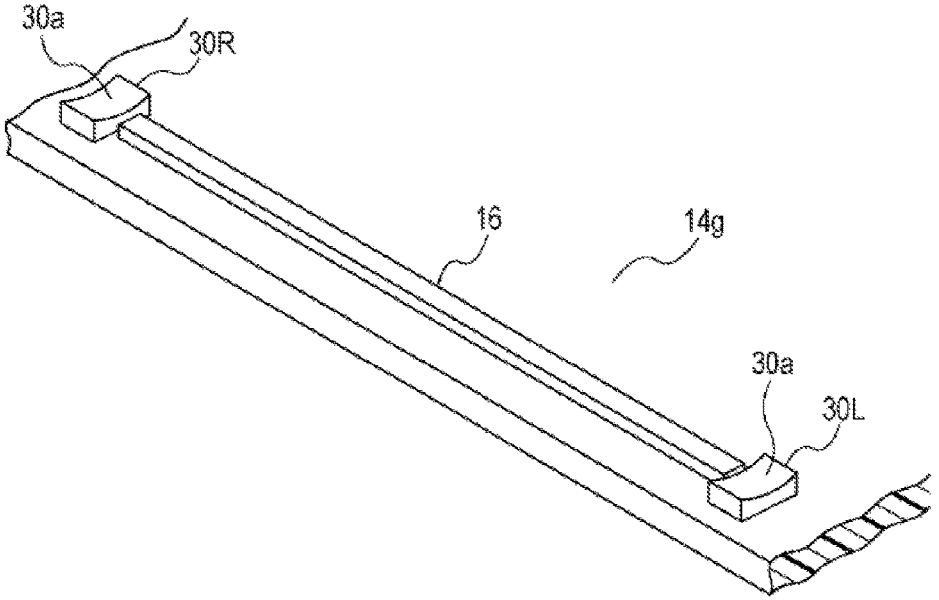
FIG. 24 is a perspective view of movement restricting portions and a developing-agent regulating portion.
Figure 25A:
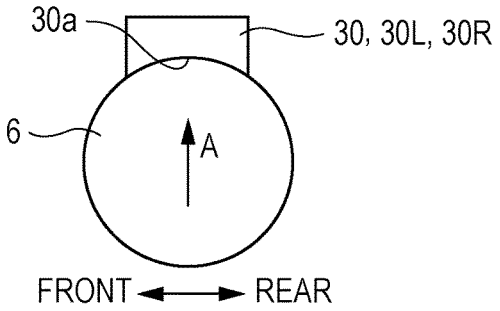
FIG. 25A illustrates the movement restricting portions.

In the sixth embodiment, the movement restricting portions 30L and 30R are located on outer sides of the developing-agent regulating portion 16 and within developing-agent non-supply region widths W6*e* in the end portions of the developing sleeve 6. As illustrated in FIG. 21, the movement restricting portions 30L and 30R are located on a downstream side of the developing sleeve 6 in the direction in which the spring members 19L and 19R pressurize the developing sleeve 6 (direction of arrow A), and the developing sleeve 6 is pressed against the movement restricting portions 30L and 30R by the spring members 19L and 19R. FIG. 24 is a partial perspective view of an inner side of a ceiling plate 14*g* of the developing container 14 on which the developing-agent regulating portion 16 and the movement restricting portions 30L and 30R are provided. The movement restricting portions 30L and 30R have developing-sleeve receiving surfaces 30*a* that receive upper sides of the end portions of the developing sleeve 6. In the sixth embodiment, the developing-sleeve receiving surfaces 30*a* are arc-shaped in accordance with the curvature of the developing sleeve 6, as schematically illustrated in FIG. 25A. That is, the developing-sleeve receiving surfaces 30*a* are curved surfaces formed along a peripheral surface of the developing sleeve 6.

The developing sleeve 6 is biased upward (in the pressurizing direction A) by the left and right bearing mechanisms 18L and 18R so that a top face thereof is brought into contact with the developing-agent regulating portion 16 in the longitudinal direction with a predetermined pressing force. Further, the upper faces of the left and right end portions of the developing sleeve 6 are fitted and received in the arc-shaped developing-sleeve receiving surfaces 30*a* of the left and right movement restricting portions 30L and 30R on the left and right outer sides of the developing sleeve 6 in the longitudinal direction.

Figure 25B:
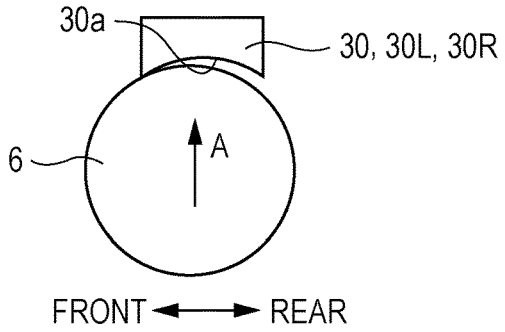
FIG. 25B illustrates the movement restricting portions.
Figure 25C:
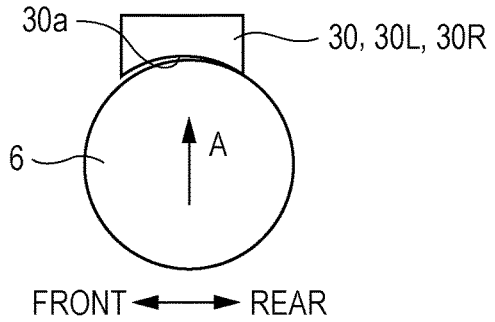
FIG. 25C illustrates the movement restricting portions.

In the sixth embodiment, the upper faces of the left and right end portions of the developing sleeve 6 are fitted and received in the left and right movement restricting portions 30L and 30R having the developing-sleeve receiving surfaces 30*a* arc-shaped along the outer peripheral surface of the developing sleeve 6. The developing sleeve 6 is thereby restricted from rocking in the front-rear direction illustrated in FIGS. 25A and 25B, that is, rock of the longitudinal ends of the developing sleeve 6 is restricted to suppress rock of the developing sleeve 6. That is, the developing sleeve 6 can be restricted from moving in the directions (directions of arrows X1 and X2 in FIG. 22) intersecting the pressurizing direction of the spring members 19 (direction of arrow A in FIG. 22).

Since the movement restricting portions 30L and 30R are in sliding contact with the surface of the bearing portion 6*a* of the developing sleeve 6 during rotation of the developing sleeve 6, they are formed of a smooth material such that frictional force to be received at that time is small. Specifically, plastic, such as polyacetal (POM), polyphenylene sulfide (PPS), or polytetrafluoroethylene (PTFE), is used.

By setting the movement restricting portions 30L and 30R on the outer sides of the developing-agent regulating portion 16, rock of the developing sleeve 6 can be suppressed without any influence on the amount of toner 5 born on the developing sleeve 6. By setting the movement restricting portions 30L and 30R in both end portions of the developing sleeve 6, rock of the developing sleeve 6 can be suppressed effectively.

While the movement restricting portions 30L and 30R can be molded integrally with the developing container 14, a member formed of a material having a higher abrasion resistance may be molded by two-color molding, or may be attached as a separate member. This can support a long-life developing device.

[Seventh Embodiment]

In the above-described sixth embodiment, the developing-sleeve receiving surfaces 30*a* of the movement restricting portions 30L and 30R are arc-shaped in accordance with the curvature of the developing sleeve 6. In this structure, the movement restricting portions 30L and 30R are in contact with the developing sleeve 6 at one point. Although this structure can suppress rock of the developing sleeve 6, the axis of the developing sleeve 6 may slightly tilt relative to the extending direction of the developing-agent regulating portion 16 (longitudinal direction of the developing-agent regulating portion 16).

Figure 26:
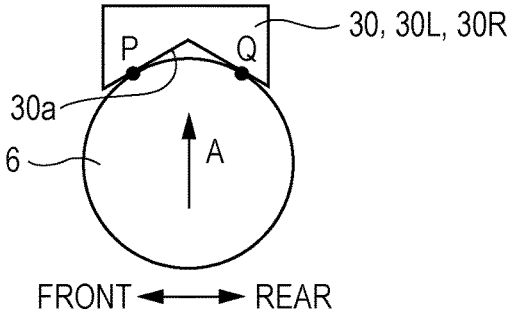
FIG. 26 illustrates movement restricting portions.

In a seventh embodiment, as schematically illustrated in FIG. 26, developing-sleeve receiving surfaces 30*a* of movement restricting portions 30L and 30R are V-shaped. In this structure, the movement restricting portions 30L and 30R are in contact with a developing sleeve 6 at two different points (two positions) P and Q in a plane orthogonal to the axis of the developing sleeve 6 (FIG. 26). In a rotating direction of the developing sleeve 6, the point P is located on a downstream side of a contact portion between the developing-agent regulating portion 16 and the developing sleeve 6, and the point Q is located on an upstream side of the contact portion. This can more reliably prevent rock of the developing sleeve 6. That is, the positions of the longitudinal end portions of the developing sleeve 6 can be more reliably determined relative to the developing-agent regulating portion 16. Thus, the amount of toner 5 born on the developing sleeve 6 in the longitudinal direction is further stabilized, and a higher quality image free from image unevenness in the longitudinal direction can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A method for manufacturing a developing device configured to develop a latent image formed on an image bearing member, the developing device comprising: a rotatable developing-agent bearing member configured to bear developing agent, a developing container configured to form a developing-agent storage chamber that stores the developing agent, and a developing-agent regulating portion supported by the developing container to regulate an amount of the developing agent born on the developing-agent bearing member, wherein the method comprises:

setting the developing-agent regulating portion on a mold; and then performing an insert molding by injecting resin in the mold to thereby integrally form the developing container and the developing-agent regulating portion.

2. The method for manufacturing the developing device according to claim 1, wherein the developing-agent regulating portion is a metallic member.

3. A method for manufacturing a process cartridge removably mounted in an image forming apparatus main body, the process cartridge comprising: an image bearing member on which a latent image is formed, a rotatable developing-agent bearing member configured to bear developing agent that develops the latent image, a developing container configured to form a developing-agent storage chamber that stores the developing agent, a developing-agent regulating portion supported by the developing container to regulate an amount of the developing agent born on the developing-agent bearing member, a support portion configured to support the developing-agent bearing member movably relative to the developing-agent regulating portion, and a pressurizing member configured to pressurize the developing-agent bearing member toward the developing-agent regulating portion, wherein the method comprises:

setting the developing-agent regulating portion on a mold; and then performing an insert molding by injecting resin in the mold to thereby integrally form the developing container and the developing-agent regulating portion.

4. The method for manufacturing the developing device according to claim 3, wherein the developing-agent regulating portion is a metallic member.

* * * * *